US007559672B1

(12) United States Patent
Parkyn et al.

(10) Patent No.: US 7,559,672 B1
(45) Date of Patent: Jul. 14, 2009

(54) LINEAR ILLUMINATION LENS WITH FRESNEL FACETS

(75) Inventors: William A. Parkyn, Lomita, CA (US); David G. Pelka, Los Angeles, CA (US)

(73) Assignee: InteLED Corporation, Gardena, CA (US)

( * ) Notice: Subject to any disclaimer, the term of this patent is extended or adjusted under 35 U.S.C. 154(b) by 0 days.

(21) Appl. No.: 12/126,843

(22) Filed: May 23, 2008

Related U.S. Application Data

(60) Provisional application No. 60/941,388, filed on Jun. 1, 2007.

(51) Int. Cl.
*F21V 5/00* (2006.01)

(52) U.S. Cl. ..... 362/244; 362/92; 362/127

(58) Field of Classification Search ..... 362/244, 362/245, 246, 336, 337, 340, 92, 326, 237–240, 362/333, 334, 338, 339, 217–225, 127, 133, 362/125; 359/457, 731, 742
See application file for complete search history.

(56) References Cited

U.S. PATENT DOCUMENTS

| | | | | |
|---|---|---|---|---|
| 3,647,148 | A * | 3/1972 | Wince | 362/223 |
| 4,337,759 | A | 7/1982 | Popovich et al. | |
| 5,436,809 | A * | 7/1995 | Brassier et al. | 362/545 |
| 5,577,493 | A | 11/1996 | Parkyn, Jr. et al. | |
| 5,584,572 | A * | 12/1996 | Ishikawa | 362/346 |
| 5,613,769 | A | 3/1997 | Parkyn, Jr. et al. | |
| 5,655,832 | A | 8/1997 | Pelka et al. | |
| 5,742,438 | A * | 4/1998 | Conner et al. | 359/743 |
| 5,806,955 | A | 9/1998 | Parkyn, Jr. et al. | |
| 5,926,320 | A | 7/1999 | Parkyn, Jr. et al. | |
| 6,575,582 | B2 * | 6/2003 | Tenmyo | 362/16 |
| 6,641,284 | B2 * | 11/2003 | Stopa et al. | 362/240 |
| 6,924,943 | B2 | 8/2005 | Minano et al. | |
| 7,011,421 | B2 * | 3/2006 | Hulse et al. | 362/84 |
| 7,042,655 | B2 | 5/2006 | Sun et al. | |
| 7,063,440 | B2 * | 6/2006 | Mohacsi et al. | 362/240 |
| 7,217,004 | B2 * | 5/2007 | Park et al. | 362/240 |
| 7,223,005 | B2 * | 5/2007 | Lamb et al. | 362/615 |
| 7,267,461 | B2 * | 9/2007 | Kan et al. | 362/373 |
| 7,273,299 | B2 | 9/2007 | Parkyn et al. | |
| 7,329,029 | B2 | 2/2008 | Chaves et al. | |
| 2007/0058369 | A1 | 3/2007 | Parkyn et al. | |

* cited by examiner

*Primary Examiner*—Gunyoung T Lee
(74) *Attorney, Agent, or Firm*—Jerry Turner Sewell

(57) ABSTRACT

A linear Fresnel lens for LED illumination is configured initially by using a meridional flux-assignment method and is then corrected by assessing the three-dimensional flux distribution of individual facets. The facet angles are slightly altered as required to produce uniformity. A variety of specialized lens shapes are generated, such as for illuminating shelves in commercial refrigerator food-display cases. The lens shapes are suitably thin for economical production by extrusion.

5 Claims, 15 Drawing Sheets

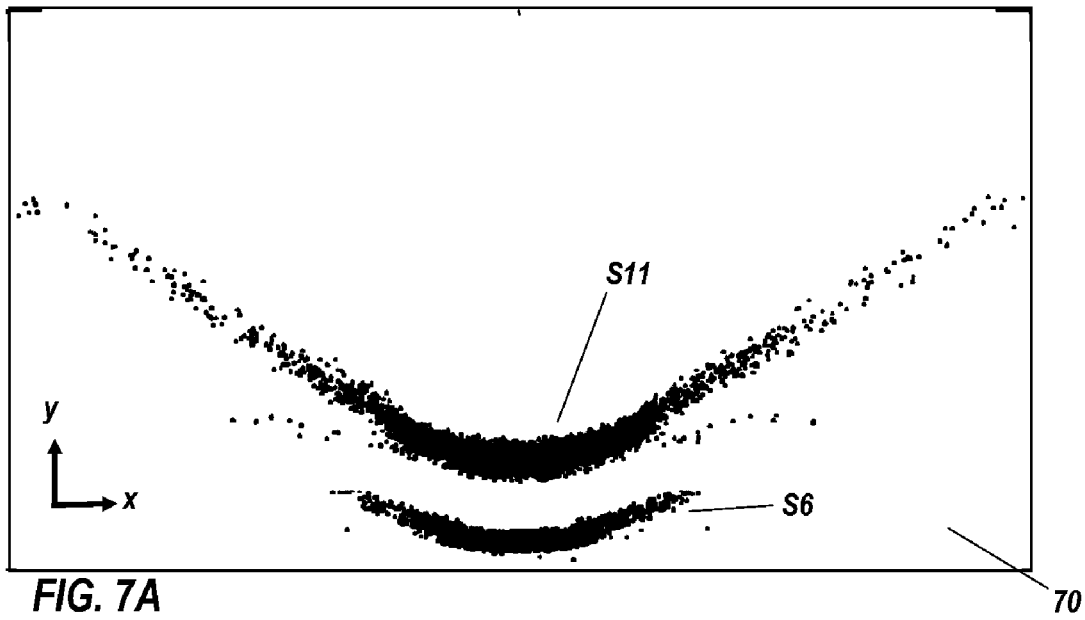
FIG. 7A
FIG 7B
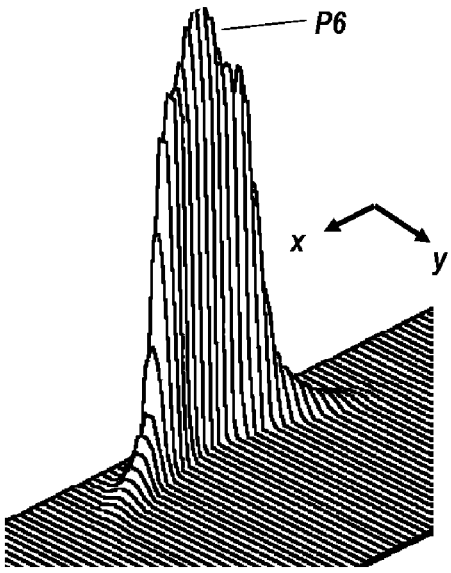
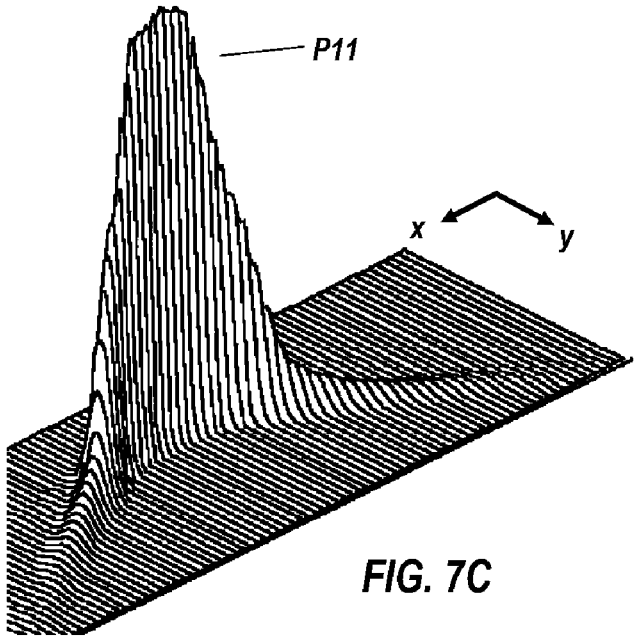
FIG. 7C

LINEAR ILLUMINATION LENS WITH FRESNEL FACETS

RELATED APPLICATIONS

The present application claims the benefit of priority under 35 U.S.C. § 119(e) to U.S. Provisional Application No. 60/941,388, filed on Jun. 1, 2007.

BACKGROUND OF THE INVENTION

1. Field of the Invention

The following disclosure and the appended claims are directed to a lens for distributing light from a plurality of linearly arranged point light sources.

2. Description of the Related Art

Light emitting diodes (LEDs) are rapidly entering the general illumination market, because of their ever-decreasing prices and ever-increasing luminous efficacy, as well as their compactness, ruggedness, and long operating life. The expanding market for LEDs as illumination sources will generate enormous national energy savings, as well as significant waste reduction from the elimination of short-lived and relatively bulky light-bulb discards. The compactness of LEDs enables precision plastic optics to be economically manufactured and integrated into lighting modules tailored for particular illumination tasks.

A prominent lighting task that is poorly served without such tailoring is shelf lighting. In the case of a line of unlensed small light sources, shelf lighting is necessarily uneven, with the illuminance falling off greatly away from the light source. With LEDs, it is possible to use lensing that will redistribute light in order to produce uniform illumination across a shelf. The two major types of lensing are individual lensing and array lensing. Individual lensing means that each LED can has a respective lens that distributes light from that LED only. Array lensing means that a line of LEDs has a cylindrically symmetric extruded lens, also known as a linear lens, for illuminating a length of shelving. Array lensing is economically advantageous because a single extruded lens replaces numerous individually molded lenses. Thus it is much easier to mount the single lens over a circuit board having a line of LEDs. For example, instead of having 50 LEDs and 50 lenses for an array of LEDs, only three parts need to be manufactured. A long circuit-board, for the array of LEDs is mounted on an extruded metal railing (or base), and an extruded plastic lens is mounted on the railing above the circuit board.

The use of a single lens for an array of LEDs presents problems. For example, it is relatively difficult to precisely extrude a lens having a thick cross section due to the uneven flow and cooling exhibited by the thicker cross sections. Accordingly, in lighting systems where the light must be bent over a large angle, it is advantageous to reduce lens-thickness by utilizing Fresnel facets. Fresnel facets eliminate the lens thickness required for smooth surfaces by providing the requisite local surface slopes for the desired refractive deflection. Conventional linear Fresnel lenses are imaging lenses and have shapes designed to minimize aberrations. For example, such conventional lenses are frequently used for solar concentration. Typically, such solar concentrators are track on a polar axis so that the sun is never more out of plane than the 23 degrees of solstice, which only causes a minimal focal blurring via reduction in focal length. Linear Fresnel lenses for solar concentration generally do not have to handle out-of-plane rays and are not useful for handling light that impinges on the lenses at substantial angles, such as occurs in a linear array of LEDs used for illumination. To date, no linear Fresnel lenses are available for illumination of nearby planar targets from a linear array of LEDs.

SUMMARY OF THE INVENTION

A need exists for a linear Fresnel lens specifically intended for illumination of nearby planar targets. The need is met by the embodiments of a linear Fresnel lens disclosed herein in which the angles of the individual Fresnel facets are selected to provide a uniform illumination of shelves arranged in planes perpendicular to the linear array of LEDs. The illumination lenses handle large amounts of out-of-plane light. Unlike conventional Fresnel lens designs, which are concerned with image fidelity, the linear illumination lenses disclosed herein rely on the principles of non-imaging optics, which are primarily concerned with flux distribution, in order to provide uniform illumination. As used herein, uniform illumination is defined as the absence of image information. For example, human vision is easily disturbed by abrupt departures from illumination uniformity, such as, for example, dark shadows or ribbons of glare.

The extruded linear lenses disclosed herein are made using dies that are much less expensive and easier to fine-tune than injection molds. In accordance with the embodiments disclosed herein, a method starts with the principles of Fresnel lens construction and introduces small adjustments to the lens-shapes of individual faces to fine-tune the resulting lens, which is suitable for production as a die-extruded lens.

Apparatuses and methods in accordance with aspects of the present invention relate generally to illumination by a line of light-emitting diodes (LEDs), and relate more particularly to linear lenses that enable such a line of LEDs to provide uniform illumination for large nearby targets, particularly display shelves and other such planar zones of illumination. The same illumination pattern is also useful for LEDs that replace the ubiquitous fluorescent tube in commercial and industrial buildings, which has recently become possible by increases in the efficacy and luminosity of commercially available LEDs. The embodiments disclosed herein provide uniform illumination in situations where conventional lighting is problematic, such as providing illumination over very wide angles of presentation by a 30" shelf only 6" from the light source. Such a situation is found within a typical large display refrigerator or freezer in a supermarket. In conventional systems using fluorescent lamps, the illumination is very uneven, which results in portions of a shelf being dark between lamps and other portions being over-illuminated close to each lamp.

The method disclosed herein develops a particular lens profile as the iterative solution of a differential equation describing the deflection of a line of rays towards a lateral coordinate on the target plane, according to a lateral cumulative-flux assignment. The method matches cumulative distributions of source and target based upon a presumed linearity of the far-field image of each LED source in the LED array. Absent the disclosed method, when large bend angles are required for light arriving at a location on the lens from a distant LED in the array, the source image becomes curved, which sends light to the wrong part of the target plane and generates non-uniformities. The disclosed method modifies the initial solution to compensate for the large bend angles to reduce the non-uniformities.

The source-image method disclosed herein determines the lens profile and the angles of the Fresnel facets. The linear source formed by the line of LEDs has a generally curved linear image in the far field. The totality of all such source images yields the target illumination pattern. The selections of the facet angles are coordinated to obtain uniform illumination. Instead of generating a lens profile in one pass of iterative integration from a lens rim to a lens center, the method disclosed herein uses two passes. The first pass generates the overall lens profile and an initial set of Fresnel facets. In a preferred embodiment, the Fresnel facets are disposed on the lens exterior. In an alternative embodiment, the Fresnel facets are disposed on the lens interior, but at a cost of efficiency. In both embodiments, the smooth surface is fixed after establishing the Fresnel facets. The illumination pattern generated by the lens profile generated in the first pass is determined. If the resultant illumination pattern is not acceptable, the second pass is performed to simultaneously adjust all the Fresnel facets via feedback from the calculated illuminance distribution on the target.

The feedback in the second pass comprises evaluating how much and in what way the illumination pattern changes when the tilt of one of the facets is slightly changed tilt. The feedback evaluation is analogous to a set of partial derivatives, with one derivative per facet. The feedback evaluation requires at least one merit function for the evaluation, but the feedback evaluation can respond to several aspects of the illumination pattern. The root-mean-square (RMS) deviation from the desired pattern is used as a global index. Accordingly, the RMS deviation is minimized first. Once the RMS deviation is minimized, two other initial flaws in the lens construction may cause a lens to fail to provide a desired pattern of illumination.

One defect in an initial illumination pattern is a single dark zone that falls below a required minimum illumination. In addition, bright streaks in the pattern may cause the illumination pattern to be unacceptable. For example, one criterion of unacceptability is a relative illumination change per inch that exceeds a maximum allowance (e.g., a 30% change in illumination per inch). Any streaks or shadows that are relatively localized are likely caused by only a few facets that are close to the streaks or shadows, so only those facets need to be adjusted. Also, the particular shape of each facet's surface (e.g., concave or convex) can be selected to alter the width of each facet's pattern to improve the overlap of illumination provided by the facets.

One aspect of the disclosed method is the ability to generate different lens shapes from the same illumination requirement. This aspect of the method results from the two degrees of freedom in the design of the linear lens. The two degrees of freedom are the respective slopes of the two surfaces that a ray encounters in a propagation path from an LED to an illuminated location. When an illumination requirement is narrow-angle, then a narrow-angle source, such as 110°, would be appropriate. Conversely, a wide-angle source is appropriate for a wide-angle illumination requirement. This type of flux-matching tends to minimize the total amount of deflection necessary. Flux-matching sets the amount of deflection that a lens must impose on each ray.

The ray-deflection provided by a lens can be apportioned differently to the two surfaces of the lens. In the prior smooth lens method, each surface of the lens provides half of the total deflection in order to minimize aberrations. In lenses that must provide large deflections, however, the outer surface of the lens can terminate out-of-plane rays because of total internal reflection (TIR) and can deflect other rays in wrong directions. To reduce losses, the inner surface of the lens can be configured to provide more than half of the amounts of any large deflections, thus reducing the amounts of the deflections that need to be provided by the more vulnerable outer surface. Moreover, small deflections (under 10 degrees) can be assigned entirely to one surface of the lens. In accordance with the method disclosed herein, the assignment of portions of the total deflection amount to the inner surface and the outer surface varies across the lens, in contrast to the prior smooth lens method that configured the lens to provide approximately 50 percent of the total deflection at each of the inner lens surface and the outer lens surface.

In accordance with preferred embodiments disclosed herein, the Fresnel facets are provided only on one of the two lens surfaces, with interior facets usually imposing a gradual loss of flux. When ray deflections must be large, however, dual faceting may be warranted if the interior facets help reduce the TIR losses of out-of-plane rays at the outer surface.

The embodiments disclosed herein provide a structurally necessary finite thickness between the optically active surfaces. The interior surface of the lens deflects out-of-plane rays to different locations on the exterior surface in contrast to the destination of the meridional ray. In order to reliably extrude the lens using dies, the facet thickness is adjusted to be no more than approximately ⅜ of the minimum lens thickness.

Another factor affecting the illumination characteristics is the extended length of the lens relative to its width. Each short section of the lens across the lens profile produces an illumination pattern similar to a butterfly wing. The illumination patterns are smoothed out when the lens is several times longer than the target width, which produces uniformity of illumination along the length of the lens as well as across it. The preferred embodiments of the lens are also useful in short lengths. For example, four short lengths of the lens can be placed in a square configuration to produce a rectangular pattern around them. Although it may not be possible to produce a completely uniform illumination, the resulting illumination pattern is acceptable for many illumination requirements, such as, for example, as lamps for parking lots. In preferred embodiments, the facet angles are only varied radially; however, auxiliary lensing may be installed on the LEDs to provide additional pattern control.

Certain LED packages, especially packages for low-output LEDs, have bullet-lenses to provide narrow-angle outputs. The embodiments disclosed herein are particularly advantageous for use with LEDs having wide output-angles, which are elements of a linear array. A common LED angular distribution is a fully hemispheric illumination output, which exhibits the Lambertian intensity shown by packages with a dome or a flat window. When the emitter of the LED is recessed in a reflector cup and the dome is flattened, the angular distribution can be restricted to less than 65°, but with its half-power point at 55°, minimizing the useless fringe of a Lambertian emitter. A further variation is the 'bat-wing' pattern of a barrel-shaped dome, as sold by the Lumileds Corporation as the LXHL series. On the other hand, the below-hemispheric dome of Osram Corporation's O-star multi-chip package with 6 LEDs provides a nearly constant illumination intensity out to approximately 80° from the center of the LED.

When used as light sources, each of the above-described LEDs has a different off-axis distribution of intensity, and thus presents a somewhat different type of optimum illumination task. With linear lenses, the distribution of the illumination from a line of sources operates as a sum of many circular sources. If the LEDs have a restricted angular distribution, each point on the lens only receives light from a portion of the entire length. This effect is advantageous for linear lenses because the restricted angular distribution reduces the quantity of out-of-plane rays, which are harder for a linear lens to control. Regardless of the angular width of the illumination target of a linear lens, the preferred LED source is the LED source with the closest width. In the cases of close and thus wide-angle targets, a wide angle source will be desirable. In such cases, a tailored dome placed on the LED packages advantageously optimizes the performance of the linear lens. Because of the small size and high production volumes of LED packages, this would in practice be limited to domes configured as ellipsoids with the long axis of the ellipsoid oriented transversely. However, the linear lenses disclosed herein are intended to avoid any need to include secondary optics on the individual LEDs.

Different LED emission patterns and different target positions are disclosed to provide different linear Fresnel lens embodiments. In preferred embodiments, the method comprises three steps. In a first step, the preferred method operates with in-plane rays and selects an initial transverse flux-assignment. The method derives a ray-deflection function using knowledge of the LED output distribution, and apportions ray-deflections between the inside and outside surfaces of the lens. The first step of the method results in an initial Fresnel design.

In a second step, the preferred method ray-traces with a large number of rays distributed in accordance with the known distribution of the LED source in order to determine an actual output illumination pattern. The output patterns of each Fresnel facet are also determined in this step.

In a third step, the preferred method makes fine adjustments to the angles of the Fresnel facets to move the patterns from selected facets toward the darkest part of the overall pattern and away from the brightest part of the overall pattern. The third step also adjusts the individual contours of selected facets to widen the illumination patterns produced by the selected facets so that the illumination patterns overlap to eliminate streaks in the otherwise uniform output.

Certain preferred embodiments are disclosed herein that are described by the contour of one surface (e.g., the smooth surface) and by the facet locations and angles on the other surface, which follows the contour of the first surface. To facilitate extrusion, the depths of the facets are confined to being only a fraction of the lens thickness, such as, for example, one-eighth of the lens thickness. The contour can be expressed as a polynomial with enough terms to be more accurate than the accuracy of the actual extruded. Thus, the embodiments disclosed herein are advantageously described as a combination of a smooth-surface polynomial, a thickness, and a list of facet locations and angles.

BRIEF DESCRIPTION OF THE DRAWINGS

The above and other aspects, features, and advantages of these preferred embodiments will be more apparent from the following more particular description thereof, presented in conjunction with the following drawings wherein:

FIG. 7A illustrates a spot diagram for same the end mullion light of FIGS. 6A-6F;

FIG. 7B illustrates a flux plot for the Facet 6;

FIG. 7C illustrates a flux plot for the Facet 11;

DETAILED DESCRIPTION OF THE PREFERRED EMBODIMENT

A long linear light source, such as a fluorescent tube, or a line of compact light sources such as LEDs, have a large fraction (e.g., often more than half) of the total lamp-flux produced by the source propagating as significantly out-of-plane rays when considered relative to a reference plane, normal to the length of the source. As illustrated below, the light source disclosed herein is a linear array of LEDs that have a longitudinal axis. The LEDs are positioned beneath an extruded linear lens that has a longitudinal lens axis, which is parallel to the array's longitudinal axis. The lens has a cross-sectional profile defined in a reference plane orthogonal to the lens axis and orthogonal to the array's longitudinal axis. The cross-sectional profile of the lens is linearly swept in the direction of the lens axis to create the linear lens in a desired length. The system and method disclosed herein for a linear lens may be utilized to produce a large lens in a circle instead of the straight line for use in an embodiment having toroidal-shaped fluorescent tubes. The preferred embodiments disclosed herein are directed to light sources comprising a linear array of LEDs with circularly symmetric intensity profiles.

Figures 1A, 1B, 1C:
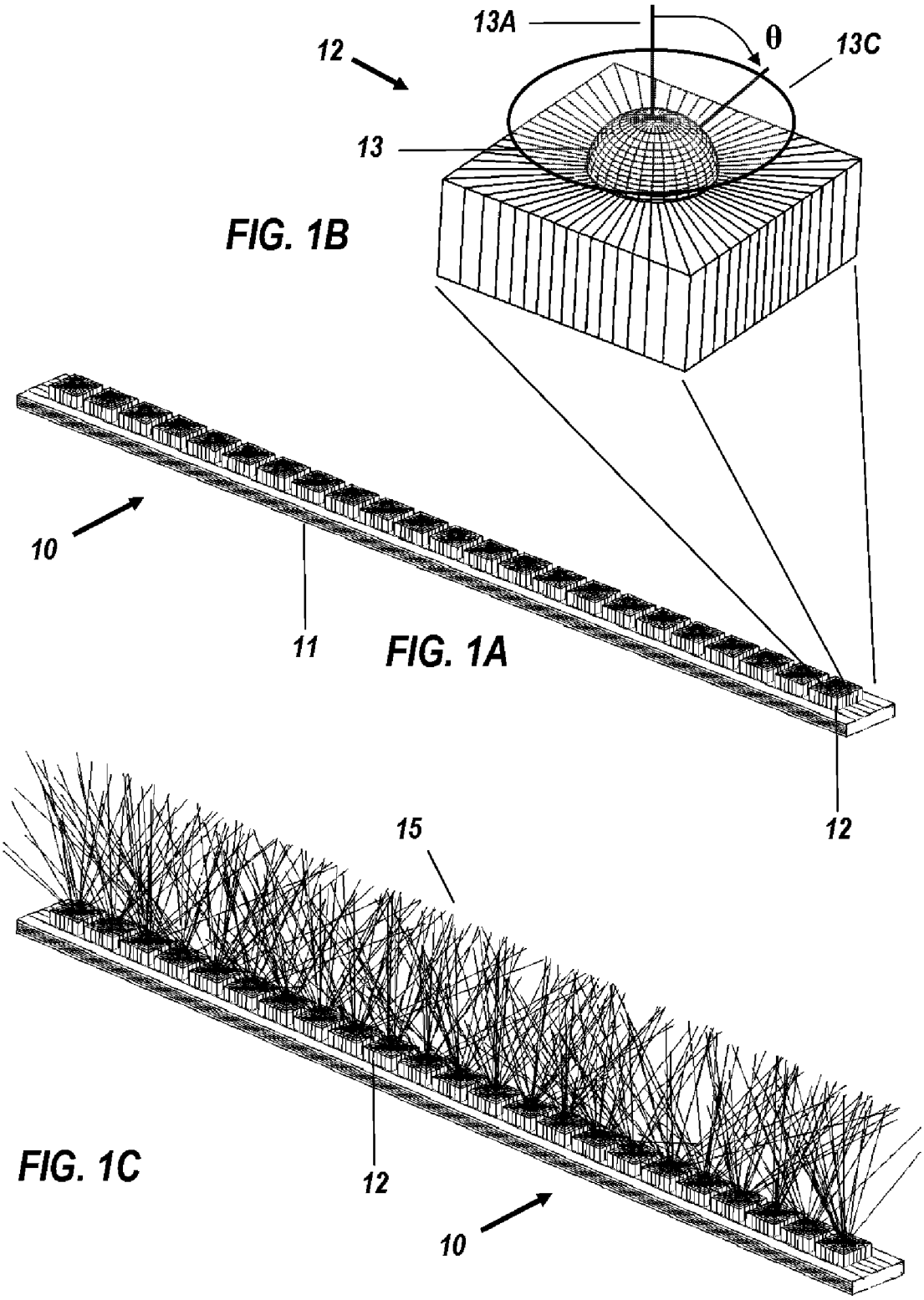
FIG. 1A illustrates a line of LEDs on a circuit board, with one LED enlarged to show additional detail of the structure of each LED.
FIG. 1B illustrates a close-up view of one of the LEDs of FIG. 1.
FIG. 1C illustrates same emitting rays.

FIG. 1A illustrates a linear light strip 10 that comprises a circuit board 11. A plurality of LED packages 12 are mounted on the circuit board 11 at a spacing of three per inch in the illustrated embodiment. The right-most LED package 12 is enlarged in FIG. 1B to show that the package comprises a generally hemispherical transparent dome 13 positioned on a rectangular base 14. The base 14 includes two direct current (DC) electrodes (not shown) that are coupled to a source of electrical energy via conducting paths (not shown) in the circuit board 11. The light produced by an LED semiconductor device in the base 14 is emitted via the dome 13. The illustrated configuration is commercially available in a so-called "SuperFlux" package from a number of suppliers, such as, for example, Lumileds Lighting, LLC, of San Jose, Calif. The configuration is available in a variety of wavelengths and emission patterns. In the illustrated embodiment, the color is white and the emitting phosphor (not shown) is disposed beneath the equator of dome 13. The emission from the dome 13 is symmetric about an axis 13A, which is vertical (e.g., normal to the face of the base 14). Thus, the far-field intensity I of the light emission through the dome 13 has a total angular width of 110° at full-width half-maximum (FWHM). An off-axis angle $\theta$ is shown in FIG. 1A relative to the vertical axis 13A. The angle $\theta$ defines an elemental emission cone 13C, an infinitesimally thin conical sheet that defines the emission between the angle $\theta$ and the angle $\theta+d\theta$ into the solid angle $d\Omega=2\pi(\sin\theta)d\theta$.

FIG. 1C also illustrates a plurality of rays 15, which are generated using the Monte Carlo method. In accordance with the method disclosed herein, the rays 15 are used to represent the light output of light strip 10 in order to analyze the linear lens and determine optimal positioning of the lens facets.

Figure 1D:
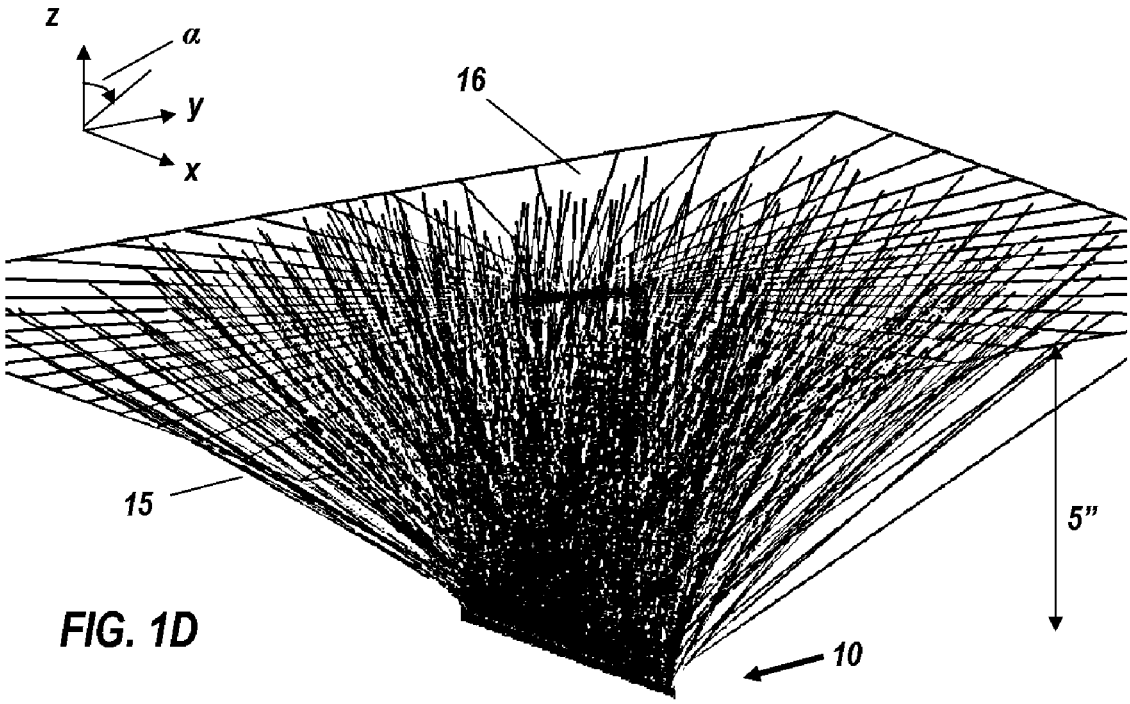
FIG. 1D illustrates the emission illuminating a nearby target plane.

FIG. 1D illustrates a target plane 16 being illuminated by the rays 15 from the light strip 10. The coordinate axes x, y, and z are shown aligned with light strip 10 and plane 16. In particular, the x-axis is aligned with the longitudinal axis of the light strip 10. The z-axis is perpendicular to the light strip 10 in the direction of the axis 13A of FIG. 1A. The y-axis is perpendicular to the x-axis and is also perpendicular to the z-axis. The plane 16 is parallel to the x-y plane defined by the x-axis and the y-axis and is thus perpendicular to the z-axis. In the illustrated embodiment, the plane 16 is offset from the origin by approximately 5 inches.

Figure 1E:
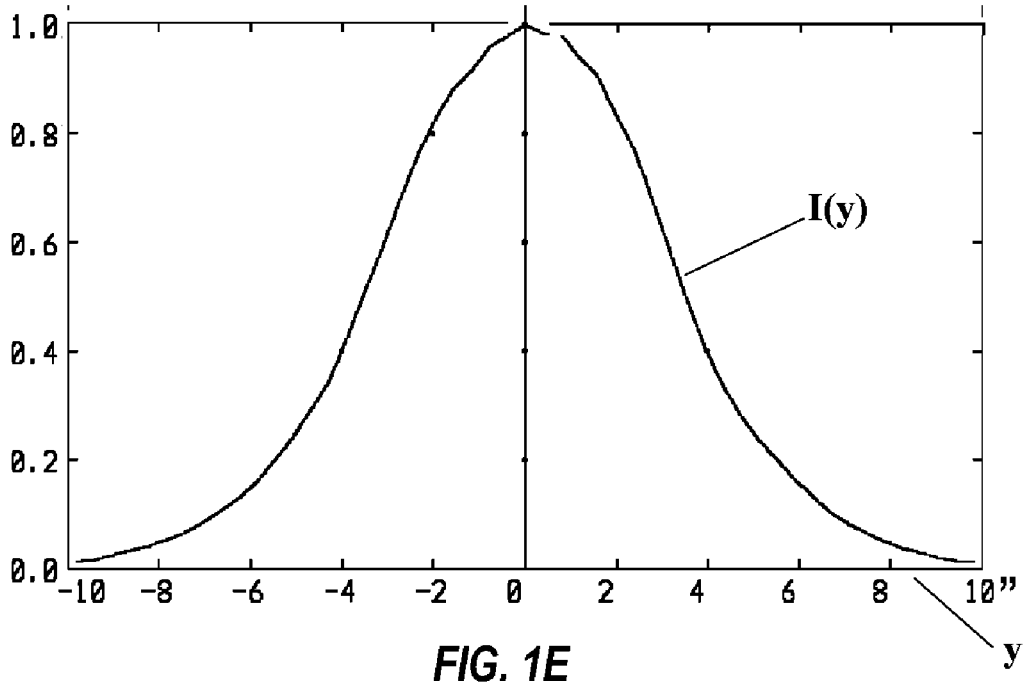
FIG. 1E illustrates a graph of the illuminance.

FIG. 1E is a graph of the illuminance I(y) on the plane 16 in the limit I(x)=constant, which is the situation when light strip 16 is much longer than the −10 to 10 range of y in FIG. 1E. This is the general case for such light-strip applications as the illumination of long shelves or refrigerated cases, as well as accent lights and troffers. The design methods disclosed herein are mathematically based on this linear geometry.

Figure 2A:
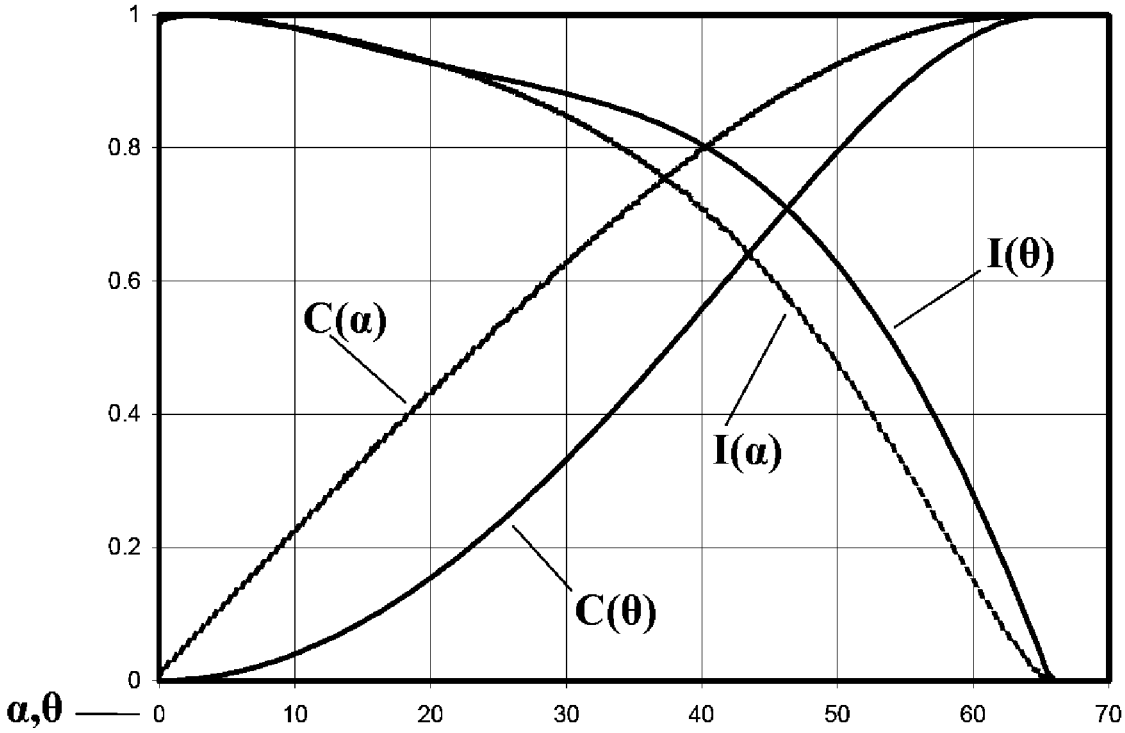
FIG. 2A illustrates a graph showing the difference between axial and lateral emission.

As discussed above, FIG. 1A illustrates the off-axis angle $\theta$. FIG. 1D illustrates a lateral angle $\alpha$, which is in the y-z plane and is at an angle with respect to the z-axis. FIG. 2A illustrates a graph with an abscissa that denotes both $\theta$ and $\alpha$ in degrees. A first curve $I(\theta)$ illustrates the off-axis intensity of a single LED with respect to the angle $\theta$. A second curve $I(\alpha)$ illustrates the lateral intensity of an entire long line of LEDs with respect to the angle $\alpha$. The second curve decreases faster at the larger values of the lateral angle $\alpha$ because fewer LEDs emit light that far out. For example, at $\alpha$=50 degrees, a sensor (e.g., a human eye) sees the nearest LED (e.g., an LED at approximately the same x location) at that same 50° angle, but the light from LEDs further up or down the line of LEDs (e.g., a greater differences in the value of x) propagates to the sensor at a steeper angle (e.g., $\theta$>50 degrees) and thus has less intensity. The cumulative intensity curve $C(\theta)$ is based on a circularly symmetric distribution, which favors larger values of $\theta$ because of the sin $\theta$ term in the integrand $d\Omega=2\pi(\sin\theta)d\theta$. The cumulative distribution $C(\alpha)$ curve is much higher than the cumulative intensity curve $C(\theta)$ because the integrand of the cumulative distribution is $d\Omega=2(\cos\alpha)d\alpha$, which differs greatly from the integrand for the cumulative intensity curve.

Figure 2B:
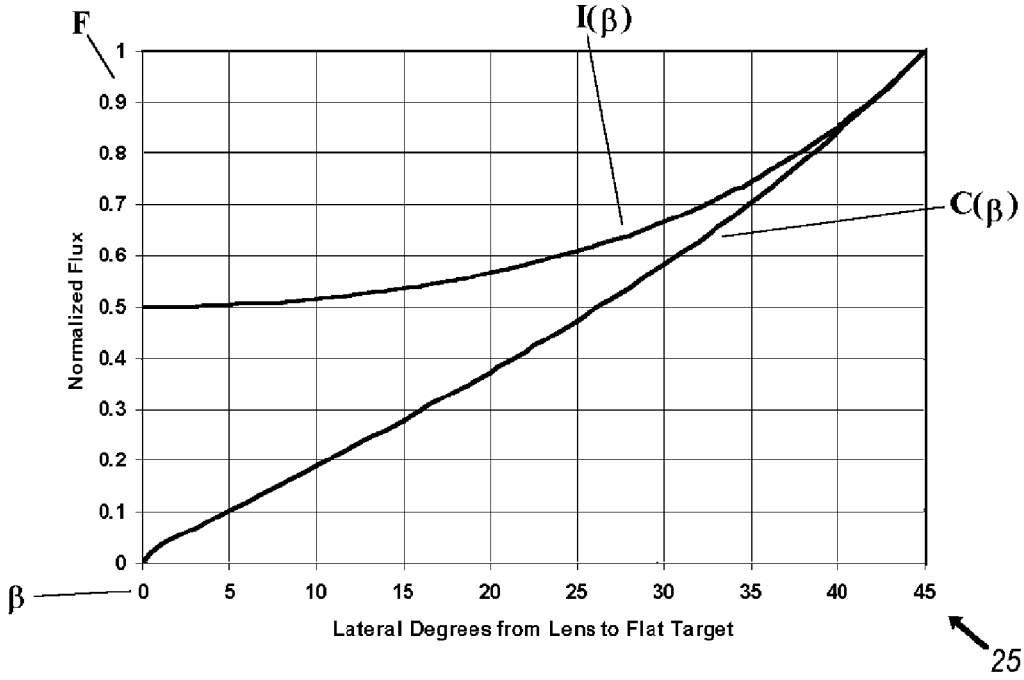
FIG. 2B illustrates a graph of intensity for uniform illumination of the target plane.

FIG. 2B illustrates a graph of the intensity required for uniform illumination of a nearby target plane out to a 45-degree lateral angle on both sides (hence the factor of 2 in $d\Omega$). For example, this range of illumination may be a customer-requirement for shelf illumination. In this example, the lateral angle is designated $\beta$ as distinct from the prior angle $\alpha$, although both angles are defined in the same plane. The designation $\beta$ is used to distinguish between the distribution $I(\alpha)$ generated by a linear source alone and the distribution $I(\beta)$ that a luminaire needs in order to generate uniform illumination on a nearby plane. Accordingly, the emission angle $\beta$ is the emission angle of the light produced by the luminaire, which is disclosed herein as a linear Fresnel lens.

In the design method disclosed herein, the curve $C(\alpha)$ of FIG. 2A forms an input function for the lens design, and the curve $C(\beta)$ is the output function. The method finds the deflection function $\beta(\alpha)$, which transforms the distribution $I(\alpha)$ into the required distribution $I(\beta)$. There is a value of $C(\alpha)$, somewhere between zero and one, for each value of the lateral angle $\alpha$, and a corresponding value of $\beta$ has the same value of $C(\beta)$.

Figure 3A:
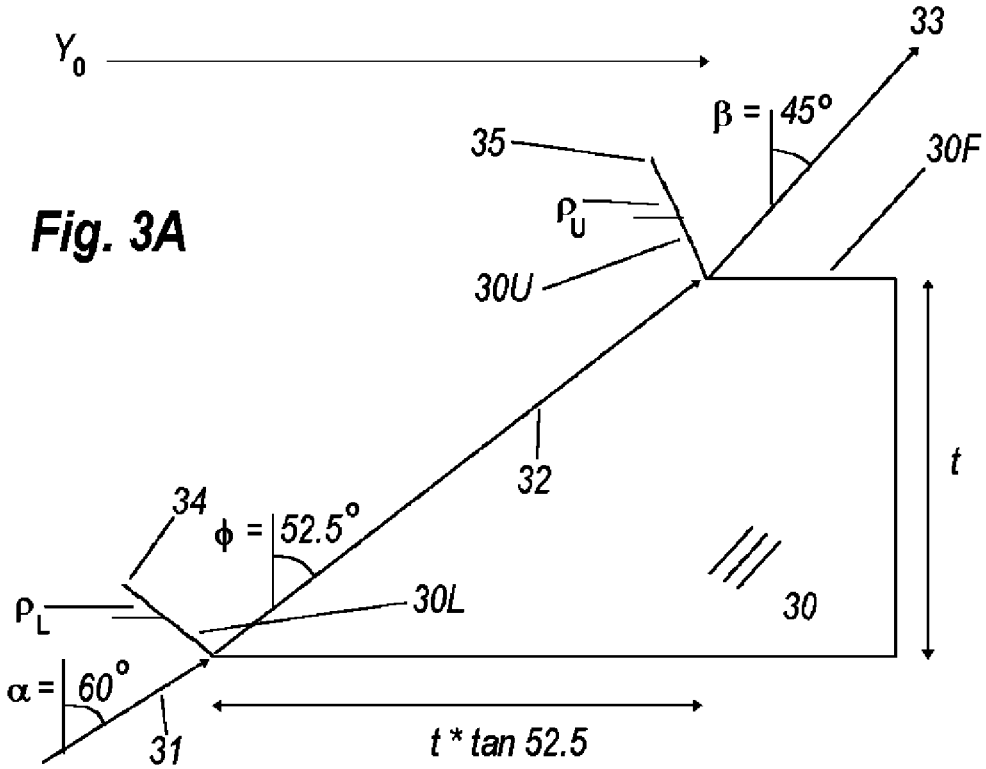
FIG. 3A illustrates the initial conditions for generating a lens profile.

FIG. 3A illustrates a method of generating the profile of a lens that generates a particular deflection function $\beta(\alpha)$, which comes from both the choice of the source illumination and the target illumination. In the illustrated method, a linear planar target subtending ±45 degrees is to be uniformly illuminated so that the graph in FIG. 2B defines the required lateral output of the linear lens. When this requirement is translated into an output deflection function $\beta(\alpha)$, numerous potential lens profiles may be generated because the deflection $\beta(\alpha)-\alpha$ is actually performed by both lens surfaces acting in succession. In certain circumstances, all the required deflection could be provided by the first, interior surface of the lens with no deflection being provided by the second, exterior surface, or vice versa. In most cases, however, a 50-50 split of the deflection at the two lens surfaces minimizes the distortion that is inevitable at useful deflections (such as 150 or more).

Figure 3B:
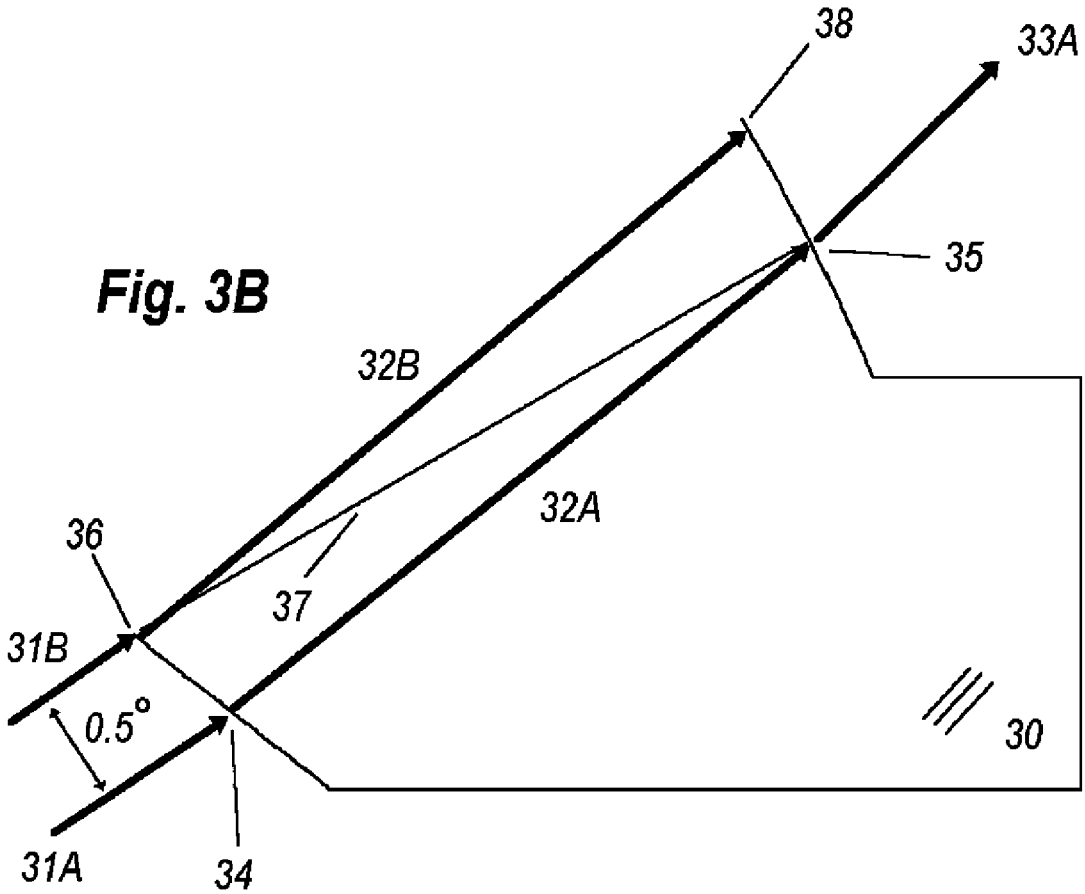
FIG. 3B illustrates at iterative step for same.
Figure 3D:
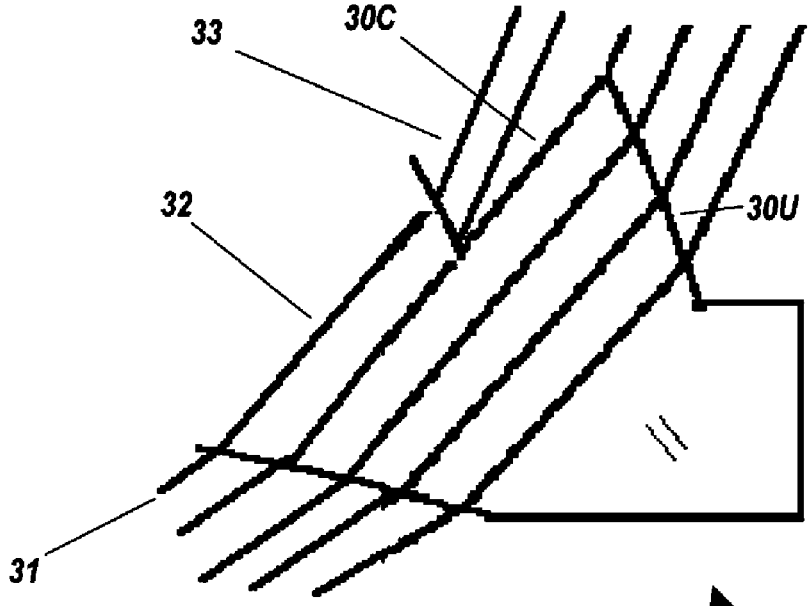
FIG. 3D illustrates an enlarged portion of the profile of the Fresnel lens in FIG. 3C within the rectangular perimeter 3D in FIG. 3C.
Figure 3C:
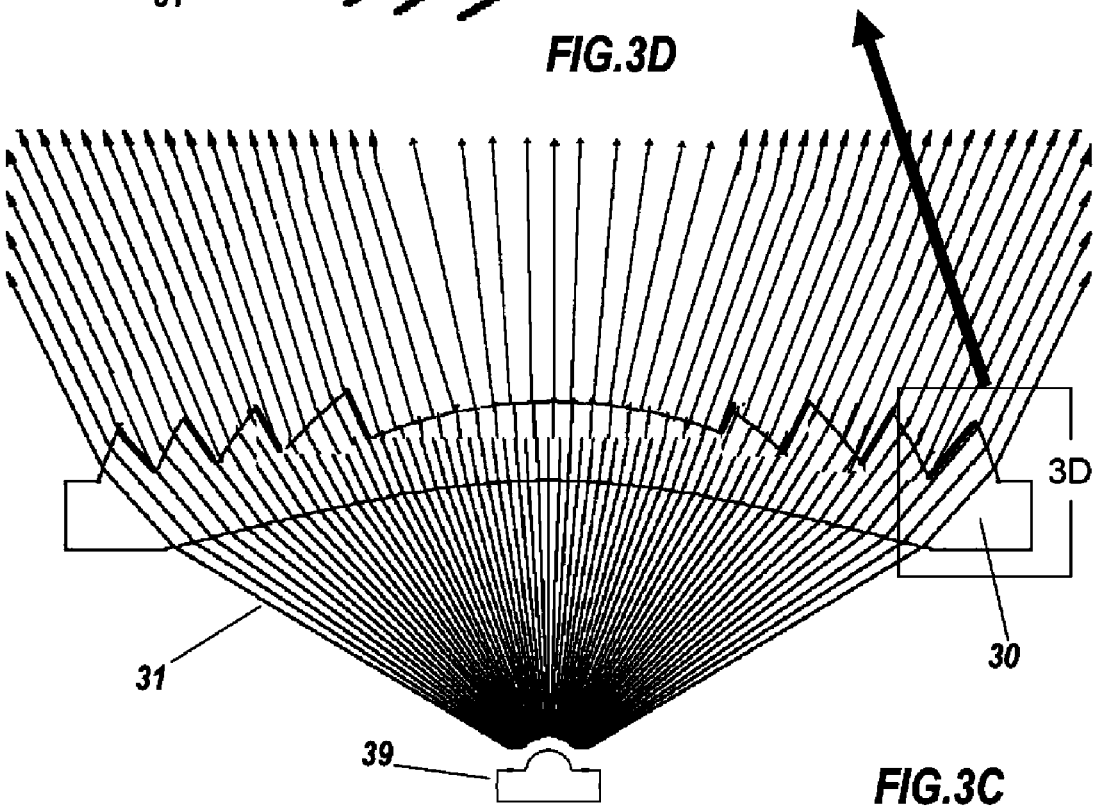
FIG. 3C illustrates the profile of the resultant Fresnel lens.

FIG. 3A illustrates a lens 30 in the initial stage of being generated. FIG. 3B illustrates how successive rays generate successive small segments of the surface. FIGS. 3C and 3D illustrate the finished lens 30 with facets selected to maintain a relatively constant lens thickness suitable for extrusion. The illustrated lens 30 utilizes a 50-50 split at the inner surface and the outer surface for the required deflection, but in other embodiments, a different split may be warranted. For example, using the exterior surface for large deflections risks the trapping of out-of-plane rays by total internal reflection. In such a case, losses could be reduced by utilizing 67/33 split with the inner (first) surface providing the greater amount of deflection. That much reliance on the first surface for deflection could lead to the first surface requiring Fresnel facets to avoid a large lens thickness. The use of Fresnel facets on the inner surface increases the potential for losses than if faceting is limited to the external lens surface.

A particular lens shape is the solution of a differential equation derived from the above-mentioned apportionment of the total deflection required for the full range of lateral angle $\alpha$, herein from 60° down to 0. FIG. 3A illustrates the initial stage of generating the profile of lens 30, shown in cross-section. Only the rightmost boundary of the lens 30 is shown in FIG. 3A. The boundary includes a flange 30F, which is suitable for mounting the completed lens. A lower surface 30L and an upper surface 30U are shown as having slope angles $\rho_L$ and $\rho_U$ with respect to horizontal. A ray 31, which comes from the center of the source (not shown) at a lateral angle $\alpha$=60°, is refracted by the lower surface 30L to form an interior ray 32 at an intermediate angle $\phi$=52.5 degrees. The interior ray 32 intercepts the top surface of the flange 30F and defines the beginning of the upper lens surface 30U. The upper lens surface 30U refractively deflects the ray by 7.5° to form a ray 33 that exits the upper lens surface 30 at an angle $\beta$=45°.

The procedure begins at the outer edge of the lens aperture, and the outermost ray is deflected from $\alpha$=60 degrees to $\beta$=45 degrees to provide a total deflection of 15 degrees. Two successive deflections of 7.5 degrees at the lower (inner) surface 30L and the upper (outer) surface 30U define the incidence angles necessary to produce the deflections. In general a deflection $\delta$ requires the incidence angle i within a lens of refractive index n to be $$i=\sin^{-1}\sqrt{[\sin^2\delta/\{(n-\cos\delta)^2+\sin^2\delta\}]}$$

In this case, $\delta$=7.5° and n=1.495 for an acrylic lens, yielding i=14.53°. This step produces slope angles $\rho_L=\phi-i$=38 degrees and $\rho_U=\phi+i$=66 degrees. Such a steep angle for $\rho_U$ requires faceting in order to be successfully extruded.

In FIG. 3A, the first portion of the lower surface profile extends from the flange 30F to a point 34 and the first portion of the upper surface profile extends from the flange 30F to a point 35. FIG. 3B illustrates the lens 30 with the lower surface profile 30L extended from the previous point 34 and with the upper surface profile 30U extended from the previous point 35. A current ray 31A intercepts the lower surface 30L at the previous point 34 at a known value of $\alpha$, which is 59.5 degrees for this example. The ray 31A is refracted into an interior ray 32A, which intercepts the upper surface 30U of the lens at the previously known point 35. Another ray 32A arrives at the lower surface 30L at a value of $\alpha$ of 59 degrees, which is 0.5 degrees less than the value of $\alpha$ for the ray 31A. The difference in values can be smaller if a smaller step if desired. From the point 34, the lower lens surface 30L continues upward and inward at the previous slope angle $\rho_L$, which is known to deflect a ray from the angle $\alpha$ to an angle $\phi$, which defines an interior ray 32B. The lower lens surface intercepts the ray 31B at the point 36, which becomes the next lower-surface coordinate. A line 37 is drawn from the point 36 on the lower surface to the previously known upper surface point 35. The trigonometric law of sines is used to calculate a distance along the ray 32B in order to determine the coordinates of new upper-surface point 38 where the ray 32B intercepts the upper surface. Thus, the previous lens points 34 and 35 are used to determine the new points 36 and 38. It is not enough to only know the slope angles $\rho_L$ and $\rho_U$ because each slope angle is only known to apply to a differential segment of surface profile near the ray. Where that segment is along the ray is not known, since the target is far enough away that the required exit angle $\beta(\alpha)$ is unchanging. It is mathematically necessary that the segments be lined up in order to generate a smooth lens profile. In the field of differential equations this is known as a contact transformation, and is the main ingredient of the disclosed method of generating linear-lens profiles.

For a given thickness criterion, the resultant profile is provided with Fresnel facets. FIG. 3C shows a linear lens profile 30 and an LED source 39. A lateral ray fan 31 is produced by the LED source 37. The lower lens surface 31L refracts the lateral ray fan 31 into resulting interior rays 32. The faceted upper lens surface 31U refracts the interior rays 32 into output rays 33 at proper angles to provide uniform illumination of a planar target subtending ±45° from the center of the LED source 37. FIG. 3C includes an enlarged view of the edge of lens 30 to illustrate how the facet cliff 30C parallels the interior rays 32 to minimize any disturbance to the interior rays proximate to the cliff. A typical facet height limit may be one third of overall thickness of the lens 30.

Figure 4A:
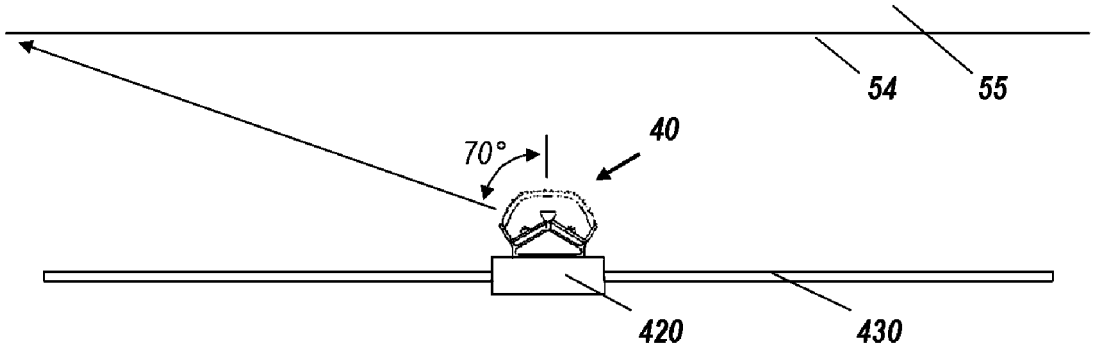
FIG. 4A illustrates a linear light illuminating a shelf.

FIG. 4A illustrates an overhead view of an illuminated shelf, with a vertically disposed linear light 40 shown from its upper end. The light 40 is mounted on the rear surface of a mullion 420, which is positioned between a pair of doors 430. The linear light 40 is positioned to illuminate display packages (not shown) placed at a front edge 54 of a horizontal shelf 55 (see FIG. 5 for context). The large lateral angle shown as 70 degrees is measured from the linear light 40 to a lateral distance halfway to the next mullion (not shown) to either side.

Figure 4B:
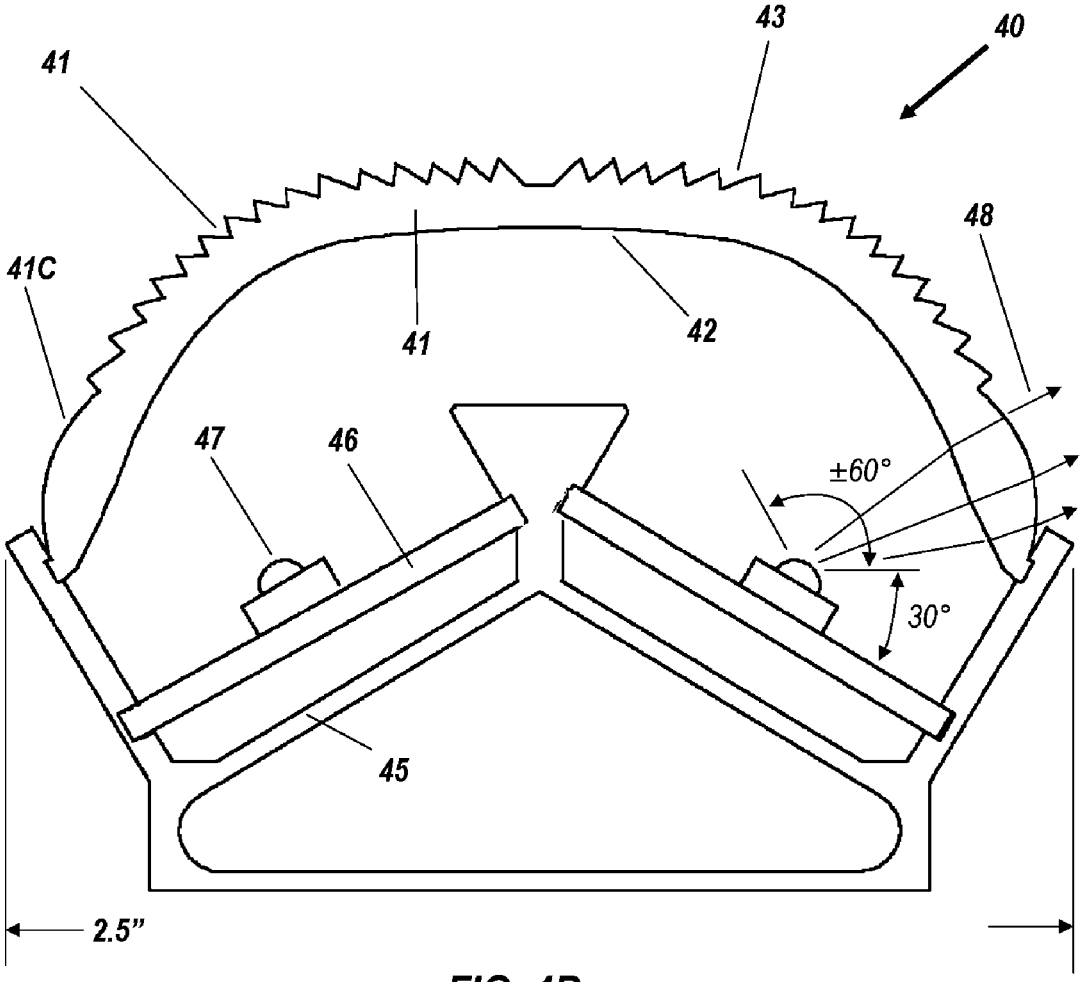
FIG. 4B illustrates an end view of the linear light.

FIG. 4B illustrates a close-up view of the linear light 40, which includes a lens 41 that comprises a smooth lower surface 42, a plurality of upper facets 43, and an outer lens 44. FIG. 4B also illustrates an aluminum extrusion 45, a pair of circuit boards 46, and two rows of LEDs 47. In the illustrated embodiment, emissions of the LEDs 47 are restricted to ±60 degrees from a normal to the surface of each LED. The restriction improves the efficiency of the LEDs because all the light from each LED is directed to the lower surface of the lens 41 rather than being wasted by impinging against the inner walls of the extrusion 45. The boards 46 are tilted at an angle of approximately 30° in the illustrated embodiment. The tilt of boards 46 and angle of the LED emission pattern makes it possible for the large 70° angle of FIG. 4A to be realized. Specifically on the outer surface of lens 41, the lowest section is convexity 41C, providing lensing sufficient that lateral rays 48, at the aforementioned 70° lateral angle boost the lateral intensity by a factor of $\cos^{-2}$ 70°=8.5 over the much smaller value generated by the LEDs alone.

Figure 4C:
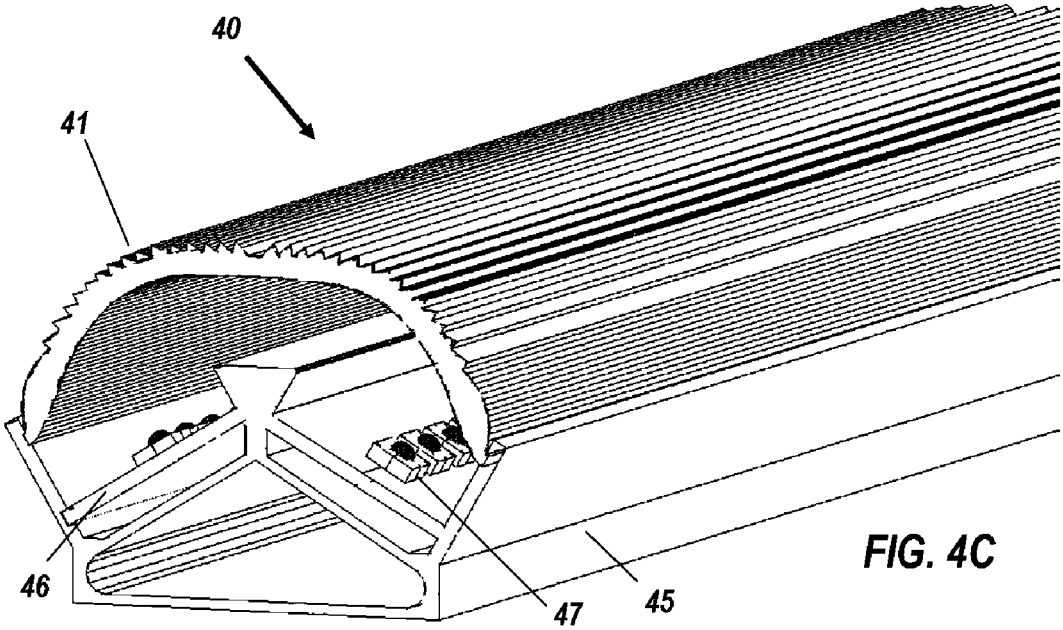
FIG. 4C illustrates is a perspective view of same.

FIG. 4C illustrates a perspective view of the linear light 40 to show the multiple LEDs 47 closely spaced in a linear array. The lens 41 actually comprises two independent sub-lenses 41A and 41B effectively joined in the x-z plane. A respective one of the sub-lenses is positioned over each line of LEDs 47.

Figure 5:
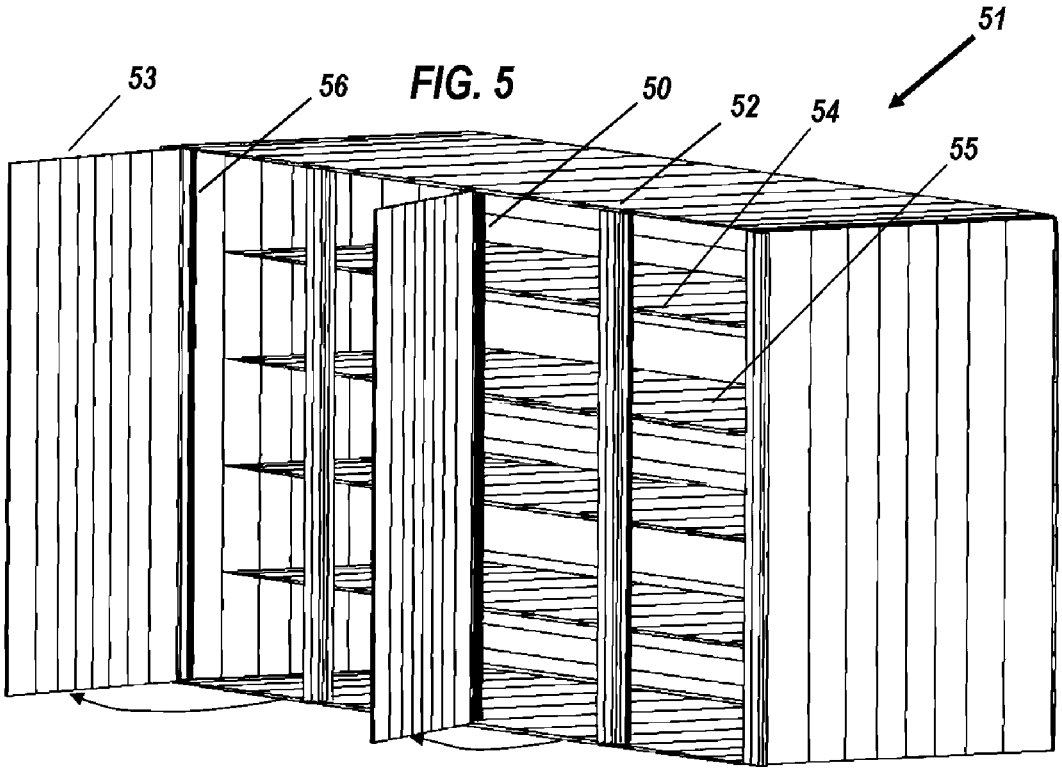
FIG. 5 illustrates the installation of same.

FIG. 5 illustrates a shelving case 51 that has center mullions 52. Each mullion is positioned between two glass-paneled doors 53. The left-hand door in each pair of doors is shown opened in FIG. 5. The light produced by a linear light 50 (the same preferred embodiment as 40 of FIG. 4A) mounted on the interior of a center post is supplemented by a corner-installed linear light 56. The lights illuminate the front edges 54 of a plurality of shelves 55. Such a configuration would be found, for example, in the refrigerators of grocery markets. The glass panels of the doors 53 are provided to enable viewing of packages placed on the front of the shelves along the edges 54 without having to open the doors unless a package is to be removed from or placed on a shelf.

Figure 6A:
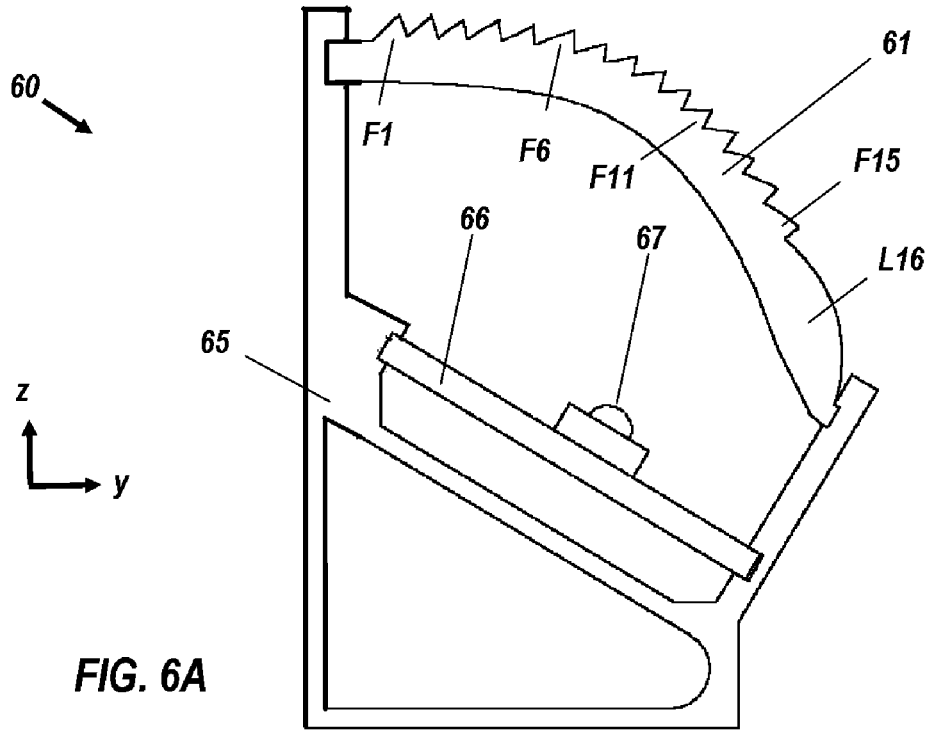
FIG. 6A illustrates an end-mullion light.

FIG. 6A illustrates a linear light 60 that can be installed in the corner of the shelving case 51 of FIG. 5. The linear light 60 comprises a lens 61, an extrusion 65, a circuit board 66, and a single row of LEDs 67. The external facets of the lens 61 are numbered from left to right with a first facet identified as F1, a sixth facet identified as F6, and a fifteenth (last) facet identified as F15. The lens 61 further includes a lens section L16 that is disposed farthest from the first face F1 and corresponds to convexity 41C of FIG. 4B. The y and z coordinate axes are shown, with the viewing direction along the x axis.

Figure 6B:
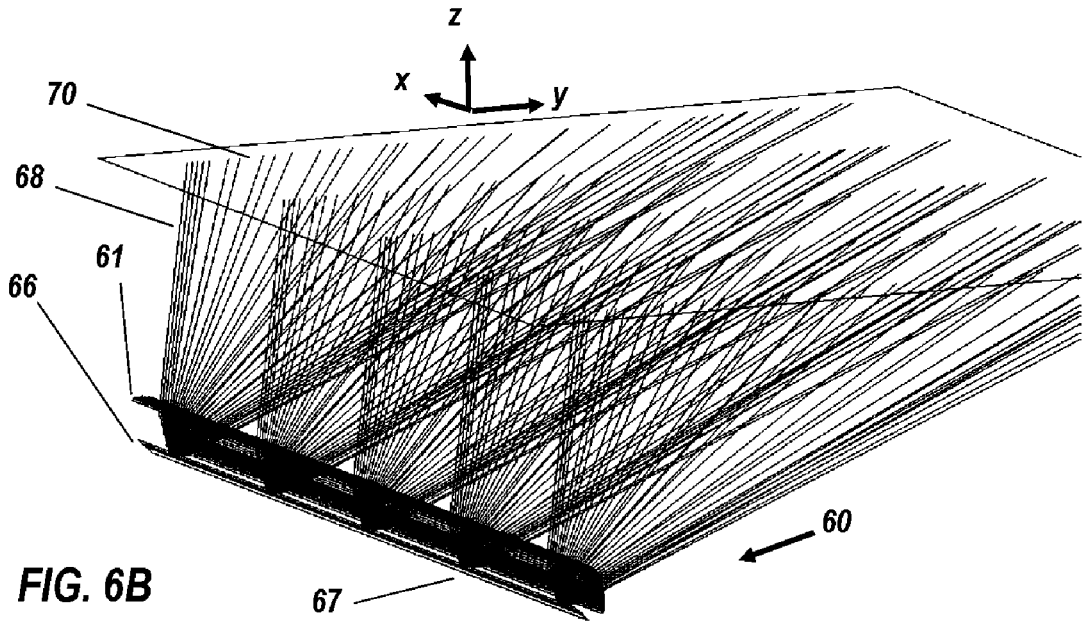
FIG. 6B illustrates a perspective view of in-plane rays produced by the end-mullion light of FIG. 6A.

FIG. 6B illustrates a perspective view of the lens 61 of FIG. 6A. FIG. 6B includes a target plane 70 that receives meridional rays 68 emitted by the LEDs 67 on the circuit board 61. The x and y coordinate directions are also shown. The target plane is parallel to a plane defined by the x-axis and the y-axis. A z-axis is perpendicular to the target plane 70. The rays 68 in FIG. 6B are only in the plane of the profile of linear lens 61. The out-of-plane rays are not shown in FIG. 6B. If the rays 68 are the only rays used for flux assignment, any assumption that the out-of-plane rays can be treated in the same manner leads to design errors, especially for bends over 15°. This can lead to lateral smearing of the assigned illuminance, which can cause nonuniform target illuminance unless accounted for. More generally, the 30° orientation of FIG. 4A and FIG. 6A were chosen to minimize the overall amount of bending the lens had to do. This is an important preliminary to designing the lens, since it will minimize the aforementioned departures from uniform illuminance.

Figure 6C:
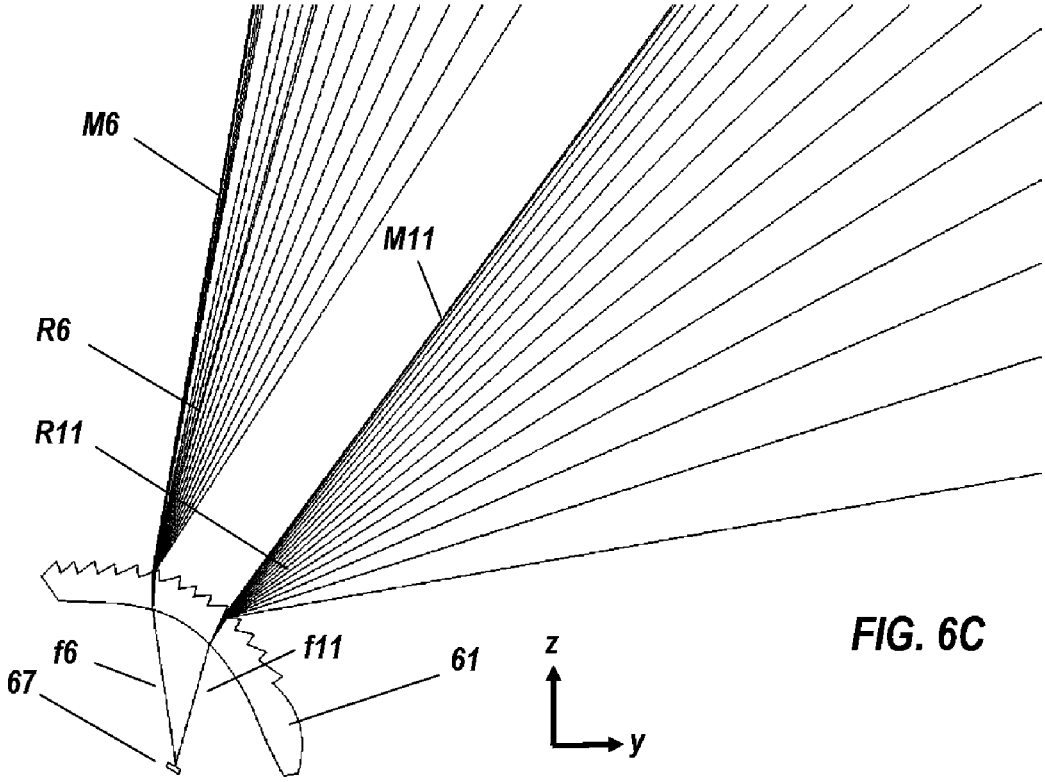
FIG. 6C illustrates an end view of out-of-plane rays produced by the end-mullion light of FIG. 6A.

The foregoing statement is illustrated in FIG. 6C, which shows an end view, along the x-axis, of the linear lens 61 and which also shows a ray-fan R6 emanating from a short length of the sixth facet F6, illuminated by input-fan f6 coming only from LEDs on a line of sight less than 60° off-axis. Similarly input fan f11 illuminates a short length of facet F11, producing ray-fan R11. The ray-set R6 has a single in-plane ray, coming from the LED of the same x-value as the short length of facet and identified as a ray M6, and the ray-set R11 has a single in-plane ray identified as a ray M11. The remaining rays in FIG. 6B result from different lateral bend angles caused by the nonlinearity of Snell's law.

Figure 6D:
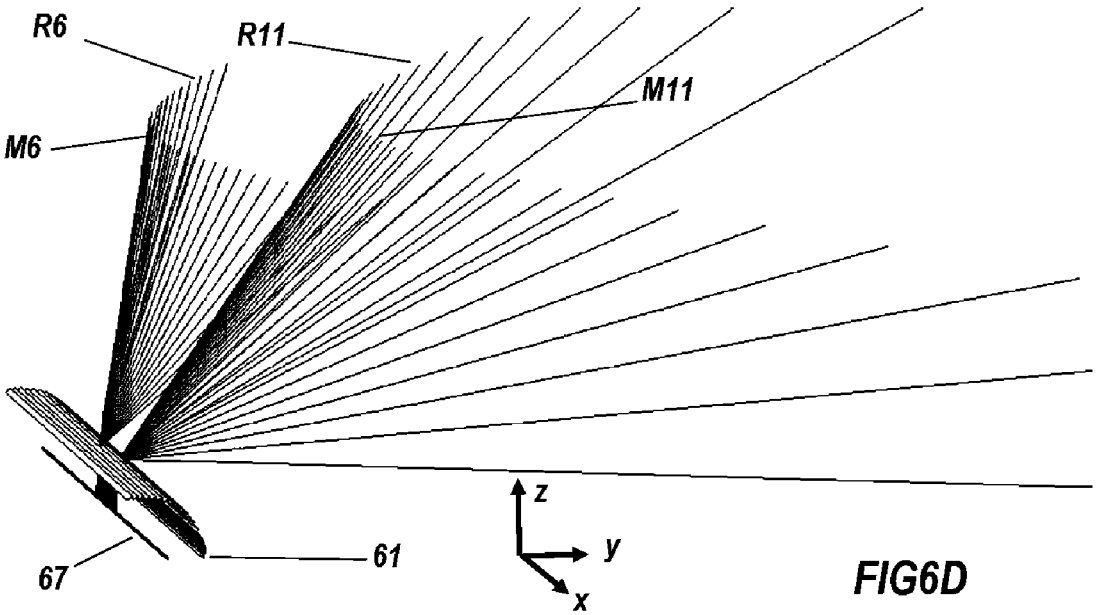
FIG. 6D illustrates a perspective view of the end-mullion light of FIG. 6A, showing the quasi-conical shape of the output rays of two facets.

FIG. 6D illustrates a perspective view of the two ray-sets R6 and R11 of FIG. 6C. As illustrated in FIG. 6D, the ray-sets R6 and R11 are quasi-conical and forming hyperbolic-style swaths on the target plane 70 (shown in FIG. 6B). These swaths in FIG. 6D represent the flux leakage away from the intended transverse coordinate of the in-plane rays. For simplification, the diagram in FIG. 6D illustrates equal numbers of rays at different out-of-plane angles, but an actual light source will have a particular intensity distribution at the off-axis angles, which would require fat vs. thin rays to be illustrated.

Figure 6E:
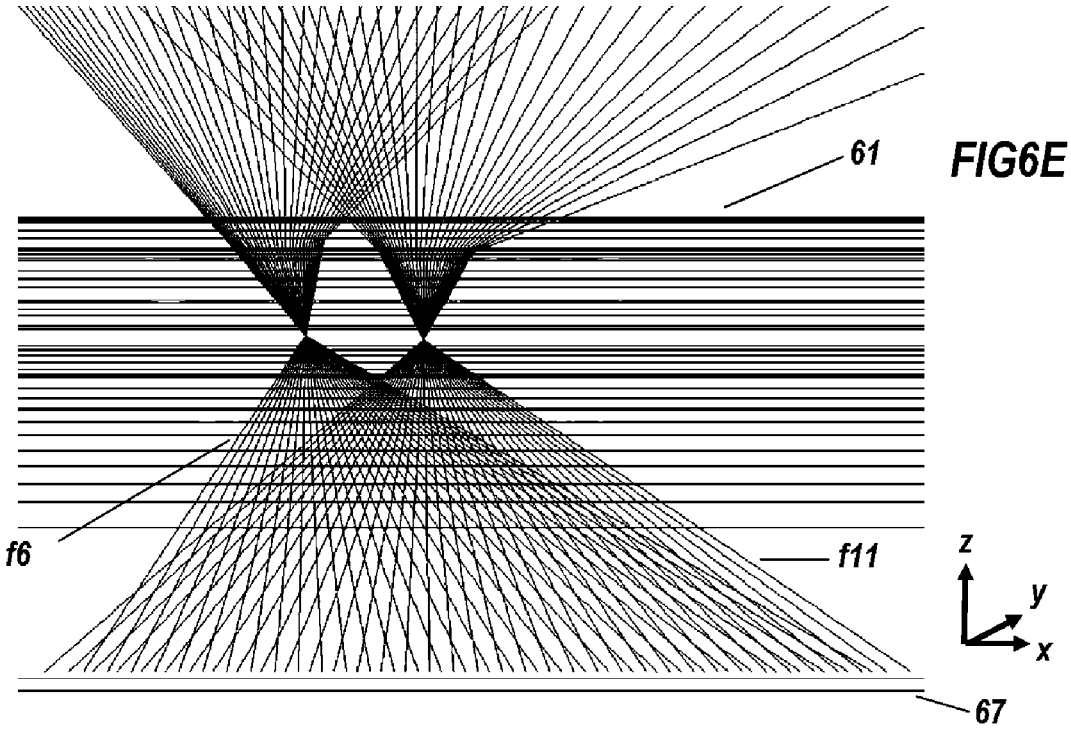
FIG. 6E illustrates an expanded view of a portion of FIG. 6D.

FIG. 6E illustrates an expanded view of the view in FIG. 6D, but rotated to show the differences in the out-of-plane angles for ray-fan f6 going to facet F6 and ray-fan f11 going to facet F11, which are all rays from the same LEDs 67, at less than the aforementioned 60° limiting emission angle. In conjunction with FIGS. 6A to 6D, FIG. 6E provides multiple views of the effect of different lateral angles on the distribution of the output rays provided by two facets.

Figure 6F:
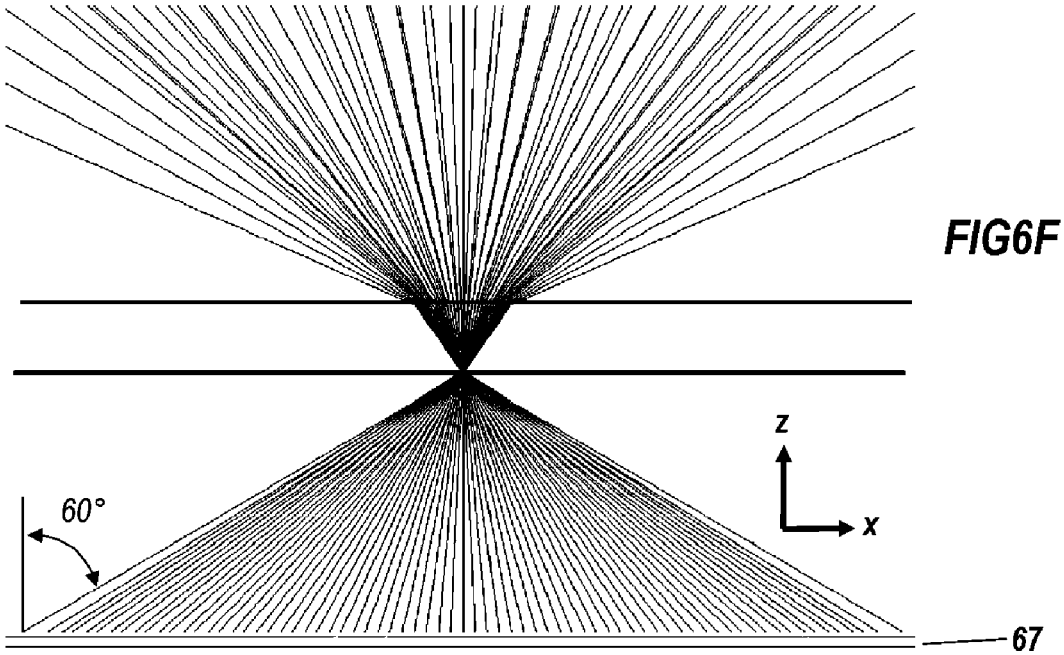
FIG. 6F illustrates a side view of the ray-fans from the LEDs to a small spot on the lens.

FIG. 6F illustrates a side view, parallel to the y-axis, of the aforementioned ray-fans from the LEDs 67 to a short length of the lens, in order to show the non-linearities in the deflections caused by different lateral angles. FIG. 6F further illustrates the limiting effect of the 60-degree emission angle of the LEDs. In particular, any LED displaced from the small spot by a distance such that the ray angle is less than the emission angle limit does provide light to the spot FIG. 7A illustrates a spot diagram on plane 70 that shows ray-intercept spots in an outwardly curved swath S6 for the sixth facet F6 and an outwardly curved swath S11 for the eleventh facet F11. Each spot represents the same flux. At higher off-axis angles there will be fewer rays, and hence fewer out-of-plane spots going out the swaths. The spot density is heavy at the center and sparse at the edges of the swath.

FIG. 7B represents a 3D flux-plot P6 for the sixth facet F6. The flux-pot P6 shows a peak flux for the in-plane rays M6 shown in FIGS. 6C and 6D. FIG. 7C illustrates a 3D flux-plot P11 for the eleventh facet F11. The plots in FIGS. 7B and 7C illustrate the bowing of the spot diagrams of FIG. 7A caused by the non-linear deflection of the out-of-axis rays shown in FIG. 6D.

Figure 7D:
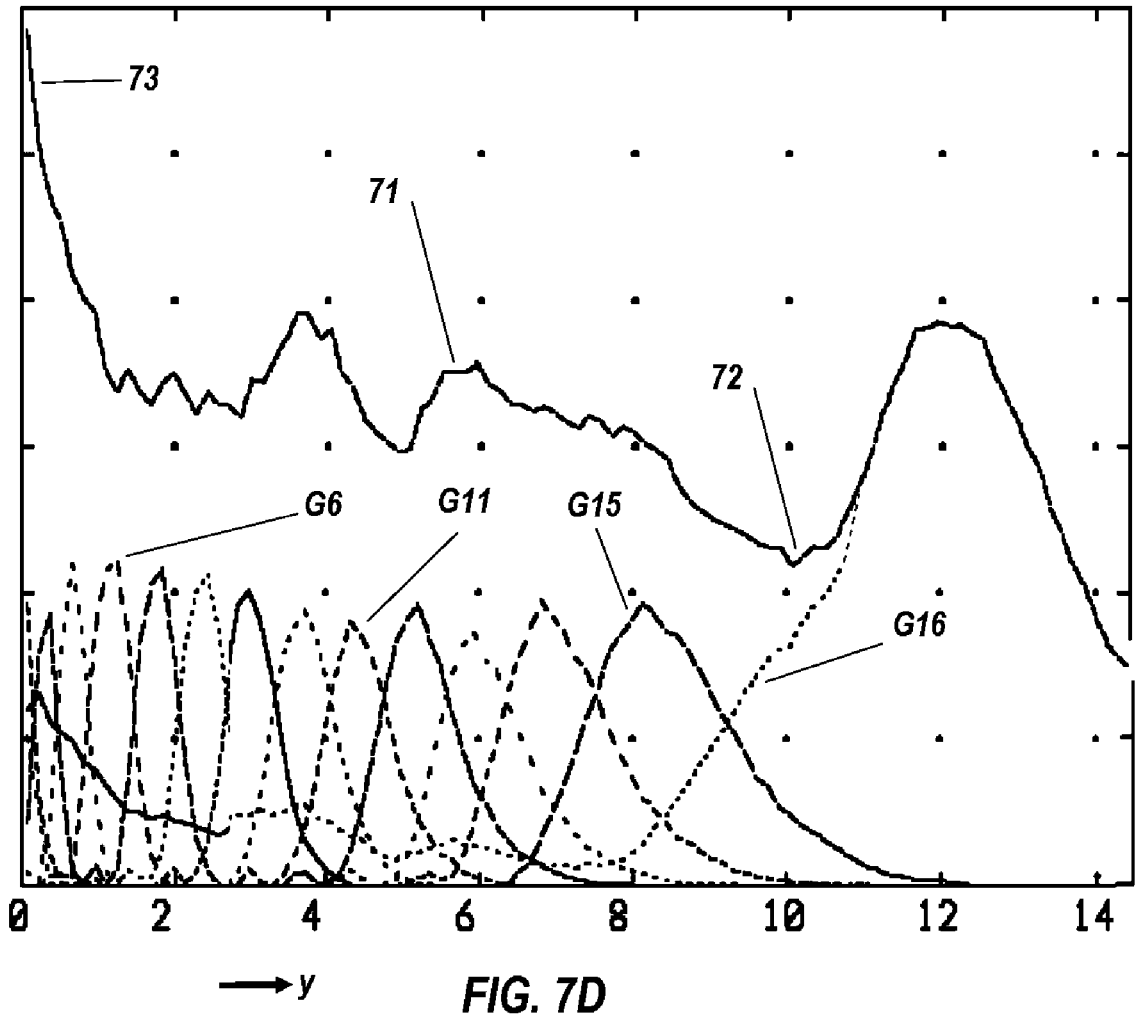
FIG. 7D illustrates a summary graph for all facets.

The plots in FIGS. 7A, 7B and 7C are only shown for a single small length of each facet; but rays emanating from the entire length of each facet impinge on and provide light to the target. Thus, the actual flux from an entire facet is a linear band of light that is generated by integrating along the entire facet length. For example, FIG. 7D illustrates graphs of flux along a transverse coordinate y, with a graph G6 labeled for the flux emanating from the facet F6, a graph labeled G11 for the flux emanating from the facet F11, and a graph labeled G16 for the flux emanating from the lens section L16. Each unlabeled graph represents the flux from one of the other facets of the lens. A graph 71 represents the flux for the entire lens and corresponds to the sum of the other 16 graphs for the various lens facets. As illustrated in FIG. 7D, the lens falls short of perfect uniformity. For example, the graph 71 includes a relatively low intensity (darker) zone 72 and a relatively high intensity (brighter) central peak 73.

The linear lens of FIG. 6A is initially configured by the flux assignment of the in-plane rays of FIG. 6B; however, the actual curved illumination patterns shown skew the actual results away from the desired uniformity. The flux intensities in the graphs of FIG. 7D show that shifting the graphs G1 through G15 shifted slightly to the right shifts a portion of the flux to the right and results in the effective shift of flux from the peak 73 to the dark zone 72 to increase the uniformity of the flux across the y coordinate. Shifting of the flux is accomplished in accordance with the system and method disclosed herein by adjusting the angles of the selected facets so that the angles are slightly steeper to increase the deflection of the light toward the lower intensity portions of the illumination pattern. The lens cross section is again produced in accordance with the method described above in connection with FIGS. 3A-3C. After the angles are adjusted and the new lens cross section is generated, the foregoing calculations of flux intensities are performed to determine whether further adjustment is necessary in order to improve the uniformity. The adjustments and calculations are repeated in an iterative process until a desired uniformity of the flux intensities is achieved or until further adjustments provide no further improvement in the uniformity of the flux intensities.

Figure 8A:
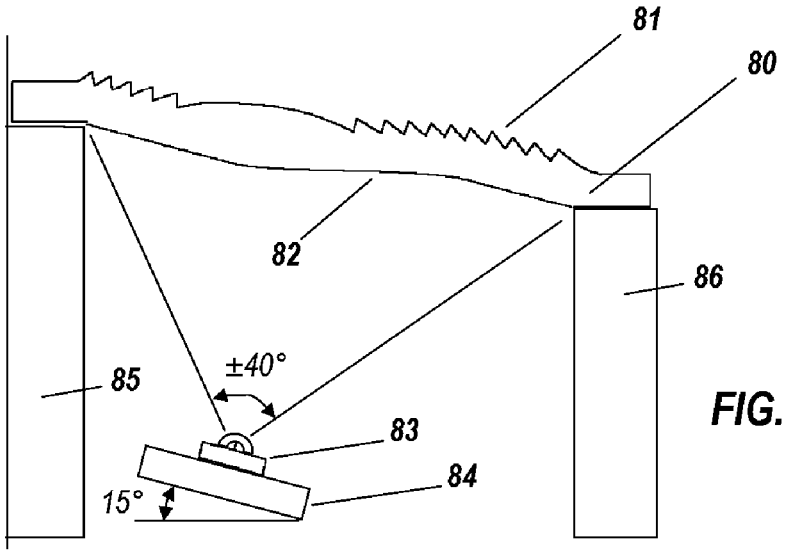
FIG. 8A illustrates a bookcase light.

FIG. 8A illustrates an end view of a linear Fresnel lens 80 that comprises an outer faceted surface 81 and a slightly curved smooth inner surface 82. An LED light source 83 comprises a line of LEDs mounted on circuit board 84. The circuit board 84 is tilted 15 degrees from the plane of a pair of mounts 85 and 86, which are mounted 6" in front of a bookcase 95 shown in FIG. 9. The lens 80 and the mounts 85 and 86 are turned over when mounted on the bookcase 95. Thus, the bookcase 95 would be up and to the right if it were shown in FIG. 8A.

Figure 8B:
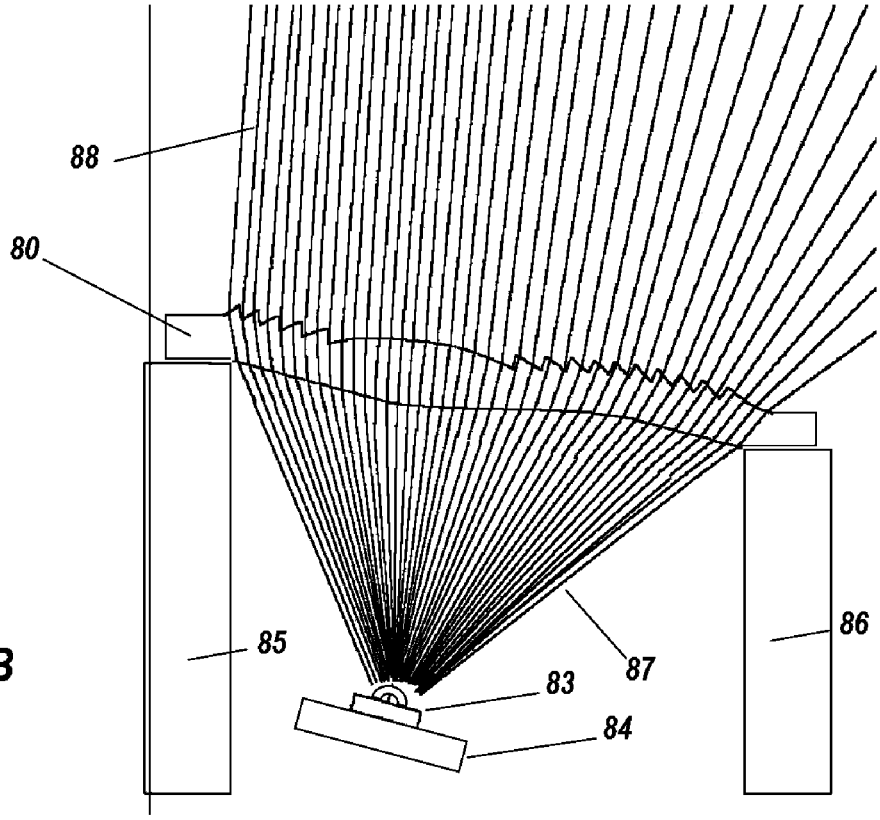
FIG. 8B illustrates the bookcase light of FIG. 8A with ray-paths.

FIG. 8B illustrates the linear Fresnel lens 80 of FIG. 8A, and further illustrates a diverging ray-fan 87 emanating from the light source 83. The ray-fan 87 is refracted by the lens 80 to produce a tailored output beam 88.

Figure 9:
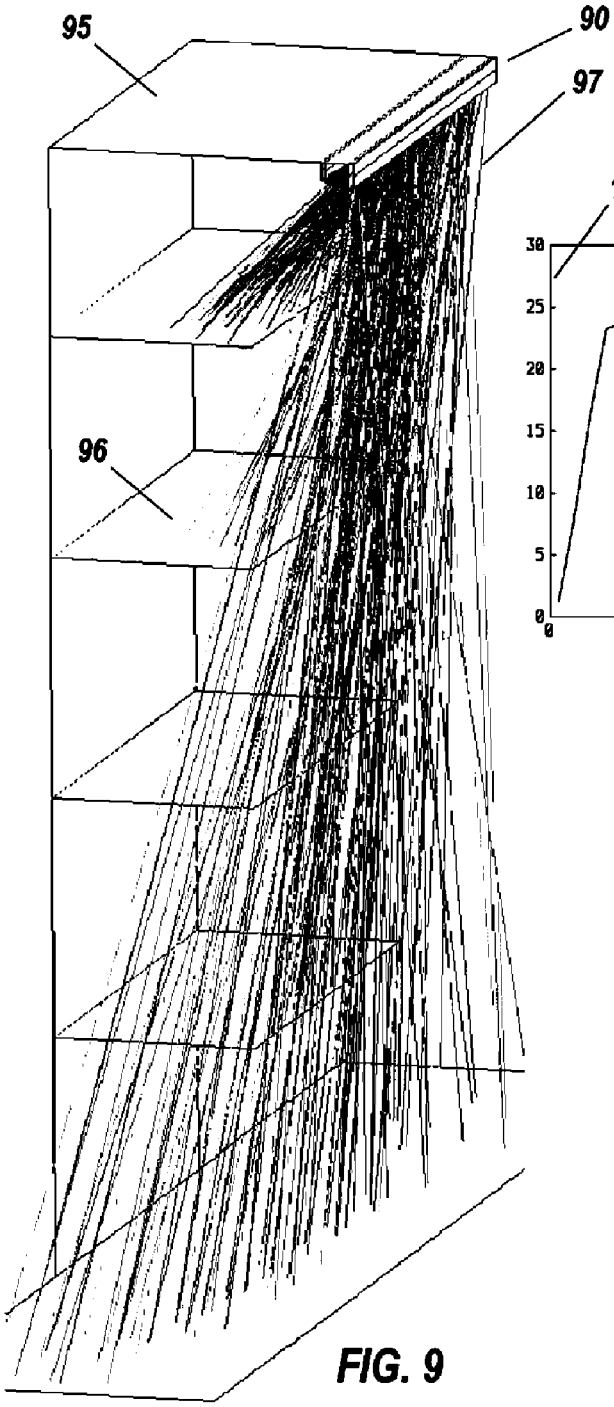
FIG. 9 illustrates the bookcase light of FIGS. 8A and 8B illuminating a bookcase.

FIG. 9 illustrates a linear luminaire 90 mounted at the top front of the bookcase 95. The luminaire 90 advantageously comprises the Fresnel lens 80, the light source 83 and the mounts 85 and 86 of FIGS. 8A and 8B. The luminaire 90 produces an output beam 97 that illuminates a plurality of shelves 96. Typically there would be many such luminaires operating on adjacent bookcases. The output beam 97 laterally widens as the beam propagates downward. Accordingly, the illumination of books standing up on the shelf 96, for example, will benefit from the light produced by luminaires operating on adjacent bookcases.

Figure 10:
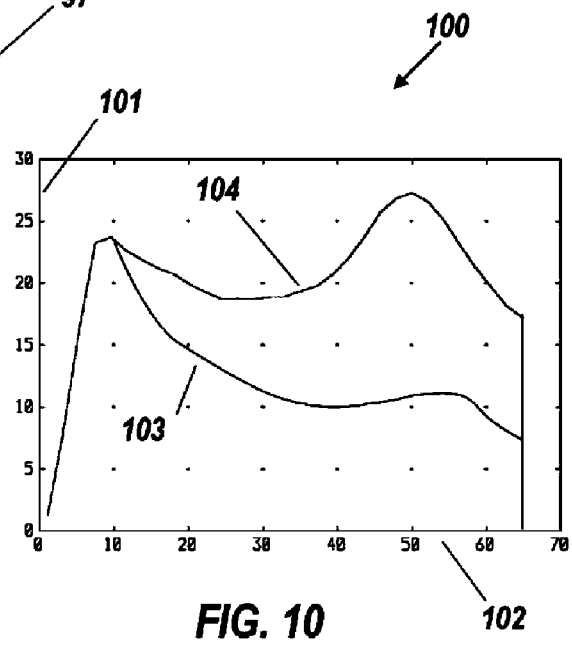
FIG. 10 illustrates an illuminance graph of same.

FIG. 10 illustrates a graph 100 of the vertical illuminance in foot candles on a vertical ordinate 101 versus the distance in inches down from the luminaire on a horizontal abscissa 102. A curve 103 represents the illuminance on the vertical front surface of a single bookcase. A curve 104 represents the illuminance provided by respective luminaires on a line of adjacent bookcases. As illustrated the curve 104 includes a peak at about 50 inches from the top of the bookcase. Having a peak in the illumination so far down is quite useful and marks a great improvement over the illumination provided by conventional tubular fluorescent lamps. Such conventional lamps typically over-illuminate the top shelf and under-illuminate the other shelves.

Figure 11:
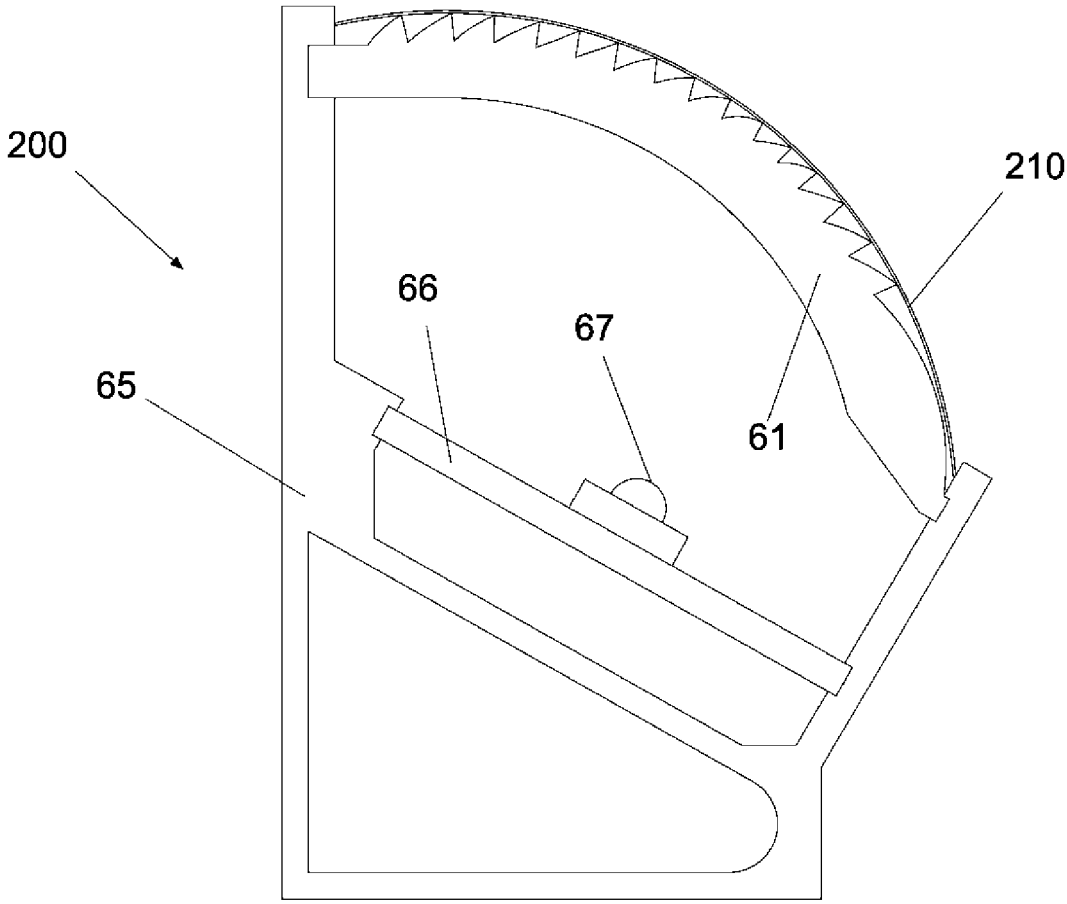
FIG. 11 illustrates the end-mullion light of FIG. 6A with a holographic diffuser added to reduce striations in the light from the lens.

FIG. 11 illustrates a linear light 200 similar to the linear light 60 of FIG. 6A that further includes a holographic diffuser 210 positioned proximate to the outer surface of the lens 61. The holographic diffuser 210 comprises a plastic (e.g., polycarbonate) film that diffuses the light that emanates from the lens 61 to reduce or eliminate any striations in the light caused by the Fresnel facets of the lens. The holographic diffuser is commercially available, for example, from Wavefront Technology, Inc., of Paramount, Calif., and from Physical Optics Corporation of Torrance, Calif. The diffusion pattern is advantageously a geometric pattern, such as, a circular pattern. In a particularly preferred embodiment, the diffusion pattern is an elliptical pattern having a major axis and a minor axis. In the preferred embodiment, the diffuser 210 is positioned over the lens 61 with the major axis perpendicular to the longitudinal axis of the lens. The diffuser 210 is attached to the lens or to the base with clips or other suitable fasteners (not shown). In an alternative embodiment (not shown), the holographic diffuser is positioned proximate to the inner surface of the lens 61. The holographic diffuser 210 can also be added to the embodiment of FIG. 4B.

The preferred embodiments disclosed herein form a family of linear Fresnel lenses for illumination that are generated by a method that first uses in-plane rays to generate a candidate lens shape. The method then makes small adjustments of the facet angles to correct for non-uniformities in the output illumination.

One skilled in art will appreciate that the foregoing embodiments are illustrative of the present invention. The present invention can be advantageously incorporated into alternative embodiments while remaining within the spirit and scope of the present invention, as defined by the appended claims

What is claimed is:

1. A linear luminaire for illuminating a shelf comprising:

a first line of compact point light sources emitting upwards and mounted on a first board, the first board being tilted with respect to a bottom of an elongated support structure; and a linear Fresnel lens disposed above the line of point light sources to receive and distribute the light produced by the point light sources, the linear Fresnel lens having an extruded cross-section with a bounded thickness between an interior surface and an exterior surface that is thin relative to a width of the lens, each of the interior and exterior surfaces having instantaneous slopes that form elemental arcuate far-field images of the line of compact point light sources, the exterior surface including a first plurality of refractive facets having a thickness less than half of the bounded thickness and including a first convex lens portion, wherein:

each of the first plurality of refractive facets has a close side and an away side with respect to the first convex lens portion, and the away side of each respective facet is longer than the close side of the respective facet;

the lens has a first support edge and a second support edge that engage the elongated support structure to position the lens with respect to the point light sources;

the first convex lens portion is located proximate the first support edge with none of the first plurality of refractive facets between the convex portion and the first support edge; and the refractive facets have instantaneous slopes selected to reduce non-uniformities in the distribution of the light flux in the far-field images produced by the facets at a target plane parallel to the line of point light sources.

2. The linear luminaire as defined in claim 1, wherein the linear Fresnel lens prescribes a lateral illumination distribution for the target plane, the prescribed lateral illumination distribution being a global sum of light distributions across the target plane from the elemental arcuate far-field images as projected upon the target plane by the linear Fresnel lens.

3. The linear luminaire as defined in claim 1, further including a holographic diffuser positioned proximate to the Fresnel lens.

4. The linear Luminaire as defined in claim 3, wherein the holographic diffuser is positioned proximate to the outer surface of the Fresnel lens.

5. The linear luminaire as defined in claim 1, further including a second line of point line sources and a second plurality of refractive facets, wherein:

each of the first plurality of refractive facets has a close side and an away side with respect to the second convex lens portion, and the away side of each respective facet is longer than the close side of the respective facet;

the second convex lens portion is located proximate the second support edge with none of the second plurality of refractive facets between the second convex lens portion and the second support edge; and the second plurality of refractive facets have instantaneous slopes selected to reduce non uniformities in the distribution of the light flux in the far-field images produced by the second plurality of facets at a target plane parallel to the second line of point light sources.

* * * * *